US011143470B1

(12) United States Patent
Roth

(10) Patent No.: US 11,143,470 B1
(45) Date of Patent: Oct. 12, 2021

(54) HINGED FIREARM RECEIVER

(71) Applicant: Parker Roth, Naples, FL (US)

(72) Inventor: Parker Roth, Naples, FL (US)

( * ) Notice: Subject to any disclaimer, the term of this patent is extended or adjusted under 35 U.S.C. 154(b) by 0 days.

(21) Appl. No.: 17/019,289

(22) Filed: Sep. 13, 2020

(51) Int. Cl.
*F41A 3/66* (2006.01)
*F41A 3/84* (2006.01)

(52) U.S. Cl.
CPC . *F41A 3/66* (2013.01); *F41A 3/84* (2013.01)

(58) Field of Classification Search
CPC ..... F41A 3/66
USPC ..... 42/75.03
See application file for complete search history.

(56) References Cited

U.S. PATENT DOCUMENTS 8,769,855 B2 * 7/2014 Law ..... F41C 23/04 42/75.03
8,991,088 B1 * 3/2015 Young ..... F41A 25/00 42/75.03
9,347,738 B1 * 5/2016 Schumacher ..... F41A 3/26
10,113,832 B2 * 10/2018 Law ..... F41C 23/04
10,704,848 B1 * 7/2020 Zeider ..... F41A 3/84
2007/0199435 A1 * 8/2007 Hochstrate ..... F41G 11/003 89/191.02
2015/0059221 A1 * 3/2015 Bero ..... F41A 3/66 42/16
2016/0084612 A1 * 3/2016 Robinson ..... F41C 23/04 42/73

OTHER PUBLICATIONS

C-4 Billet Lower-Side Folding (Internet article); https://www.newfrontierarmory.com/product/c-4-billet-lower-side-folding/ (Year: 2021 ).*

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

Provided is a hinged firearm receiver configured to operate with an AR-pattern Bolt carrier group, buffer, buffer spring, and buffer tube. The firearm upper receiver has an integral hinge that connects to a rear receiver body and provides an AR-pattern firearm the ability to have a folding stock to reduce length for storage or transportation purposes.

11 Claims, 34 Drawing Sheets

HINGED FIREARM RECEIVER

BACKGROUND

The ability for a rifle to fold its stock is advantageous. It allows the rifle to reduce its size for transportation or storage significantly. AR-pattern rifles do not inherently have folding stocks due to the recoil buffer and spring being located within the stock portion of the firearm. This puts the AR-pattern firearm at a disadvantage in some scenarios when compared to rifles with a folding stock.

Current inventions exist to provide the AR-pattern rifle with a folding stock capability. Adapters have been used to add a folding stock feature to standard AR-pattern receivers. For example, U.S. Pat. No. 8,769,855 B2. This adapter increases the length, weight, and complexity of the rifle. This adapter also requires a buffer extension, which affects the weapon system's intended recoil rate, directly effecting reliability.

Another invention to this problem is integrating a folding stock function directly into an AR-pattern lower receiver, as seen in U.S. Pat. No. 10,704,848 B1. Although this approach reduces some of the length of adding an adapter, Integrating the folding stock feature into the lower, as cited by this patent, requires the use of a non-standard buffer extension. Like the adapter, this directly adds weight to the recoil system which affects the reliability of the weapon platform.

An optimal configuration to add a folding stock feature to the AR-pattern rifle that does not affect the cycle rate of the firearm, and does not add non-required length and weight is needed.

SUMMARY OF THE INVENTION

This summary intends to introduce a simplified form of concepts further explained in the Detailed Description. The following text is not purposed to identify any claimed subject matter's key or essential features, nor is the summary designed to determine the scope of the claimed subject matter.

The present invention is a firearm receiver that is compatible with an AR-pattern bolt carrier group. This receiver includes an integrated hinge that allows for the hinged rear receiver body, that is compatible with a standard buffer tube, buffer, and buffer spring, to fold. This provides the AR-pattern rifle with a lighter and more compact folding stock feature. Utilizing a standard buffer without an extension feature is novel; other devices require a modified buffer or buffer extension to function. Both lengthen the platform and add weight to the recoiling mass, altering firearm performance in terms of its rate of fire or reliability.

The present invention also uniquely shifts the recoil force from the AR-pattern rifle lower to the upper receiver. Because the recoil force is being primarily managed by the upper receiver, as opposed to the lower, the lower may be made slimmer and lighter. This is because you are shifting recoil force management from an offset lower to inline upper, reducing leverage forces on the lower receiver during recoil operation. From a manufacturing perspective, this saves material and weight. It also opens up the possibility for the lower to be made of different materials like polymer.

DETAILED DESCRIPTION

Figure 1:
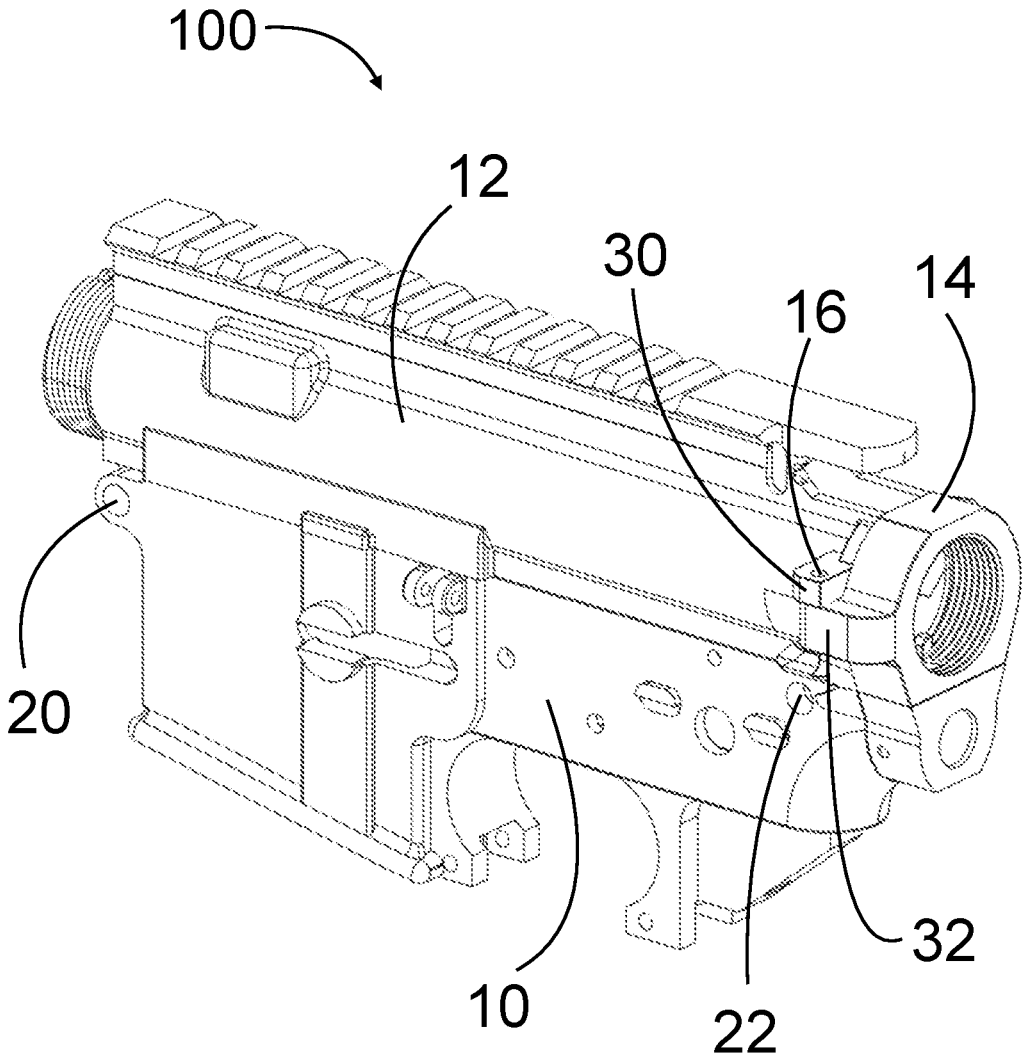
FIG. 1 is a perspective view of the Hinged Firearm Receiver with the hinge joint in the closed position.

And few of the preferred embodiments disclosed present illustration and description. Understandably, many modifications could be made without escaping the scope of the invention. Skilled artists will appreciate the many inventive concepts that qualify as equivalents under the claims. The embodiments described below do not limit the spirit of the invention nor the claims.

Every figure does not contain every reference number. Terms such as "forward," "rearward," "upper," "lower," "bottom," "top," and "side" are used to reference the orientations of the invention, as shown in the images. One skilled in the art will be able to distinguish how these orientational terms could change during the use of the invention.

Three embodiments of the claimed invention are included in the drawings, not to limit inventions scope but to show how elements and features may be moved to different receiver sections to achieve the same goal of this invention. Embodiment Hinged Firearm Receiver 100 is displayed in FIGS. 1 through 20 and includes identification numbers in the range of 10-100. Embodiment Hinged Firearm Receiver 200 is displayed in FIGS. 21 through 32 and includes identification numbers in the range of 110-200. Embodiment Hinged Firearm Receiver 300 is displayed in FIGS. 33 through 36 and includes identification numbers in the range of 210-300.

FIG. 1 displays an embodiment of a Hinged Firearm Receiver 100, with a Lower receiver 10, a forward takedown pin hole 20, a rear takedown pin hole 22, an upper receiver 12, a dead hinge section 30 integral to the upper receiver 12, a rear receiver 14, a active hinge section 32 integral to the rear receiver 14, and a hinge pivot pin 16 that creates a hinge joint with the active hinge section 32 and the dead hinge section 30 with an open and closed position. FIG. 1 displays an embodiment with the hinge joint in the closed position. When the hinge joint is in the closed position the rear receiver 14 is in the closed position. When the hinge joint is in the open position the rear receiver 14 is in the open position.

Figure 2:
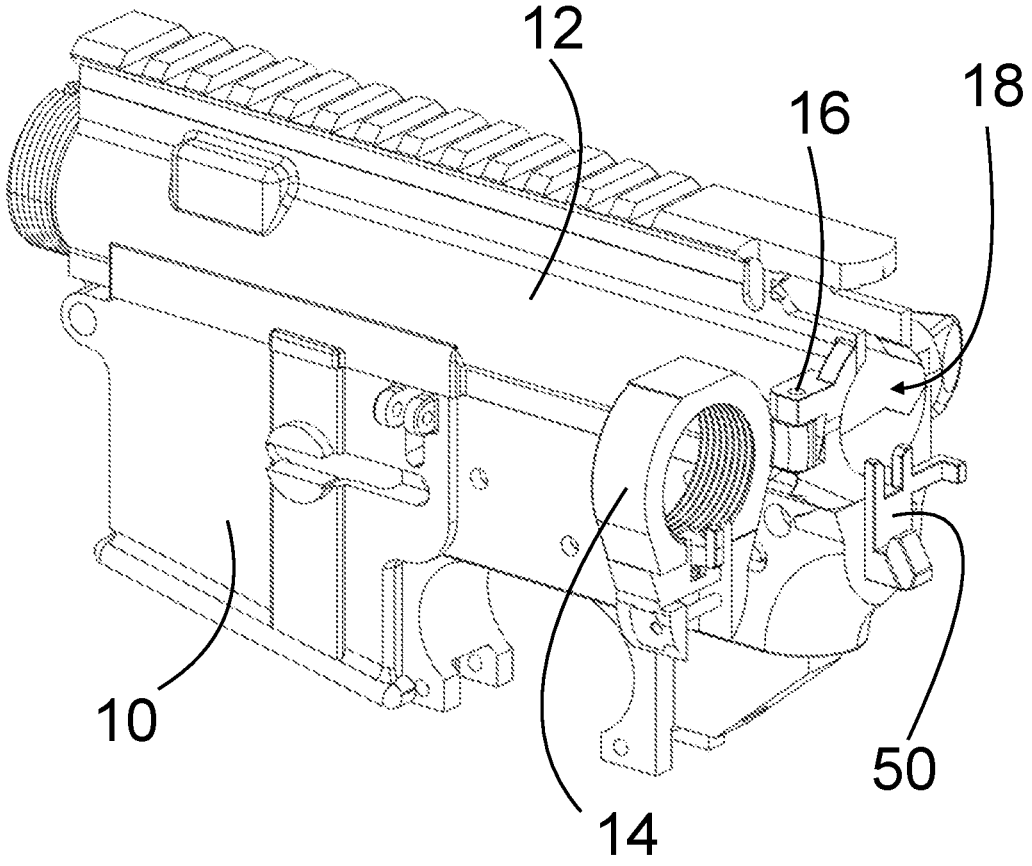
FIG. 2 is a perspective view of the Hinged Firearm Receiver with the hinge joint in the open position.

FIG. 2 displays the same embodiment as FIG. 1 with the hinge joint in the open position. The Active hinge section 32 integral to the rear receiver 14 pivots on the hinge pivot pin 16 from the closed position, which is significantly inline with the upper receiver 12 to the open position that is offset from the upper receiver 12. In an embodiment, in the open position, the latch assembly 50 is visible and in a blocking position. In the blocking position, a portion of the latch assembly 50 interferes with the bolt carrier group void circular path 18. When an ar15 pattern bolt carrier group is present in the receiver, the blocking feature limits or prevents rearward travel of said bolt carrier group.

Figure 3:
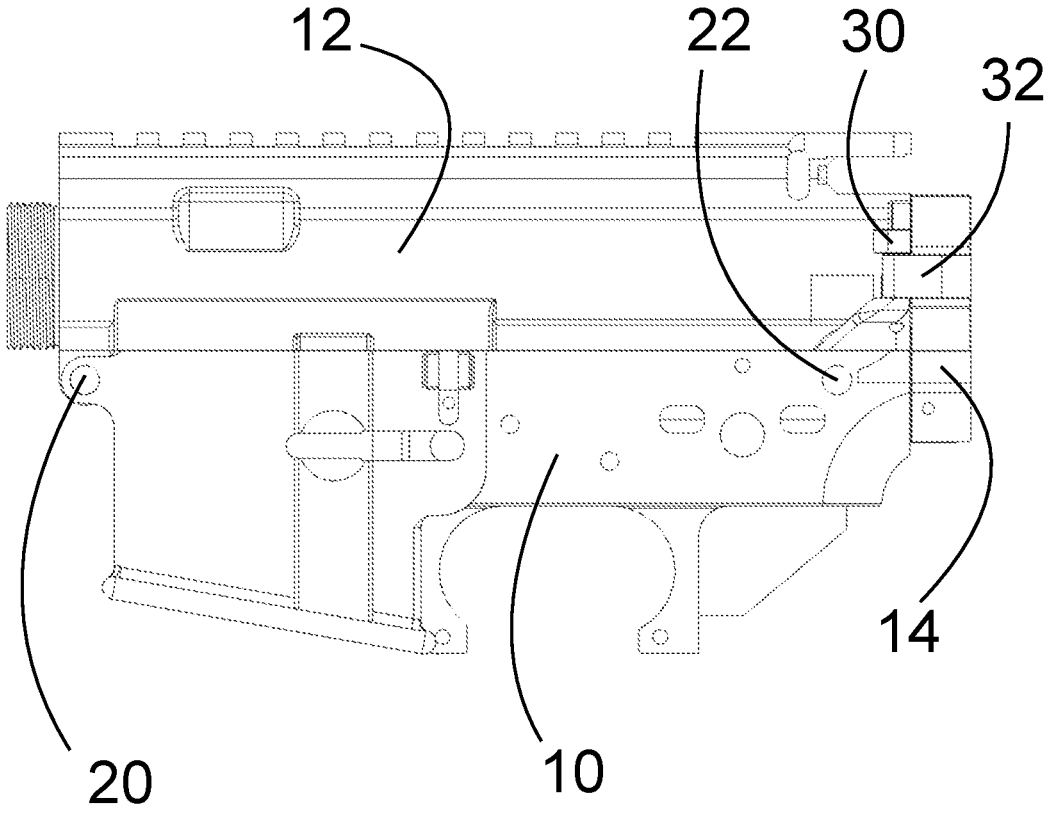
FIG. 3 is a left side elevation view of the Hinged Firearm Receiver with the hinge joint in the closed position.
Figure 4:
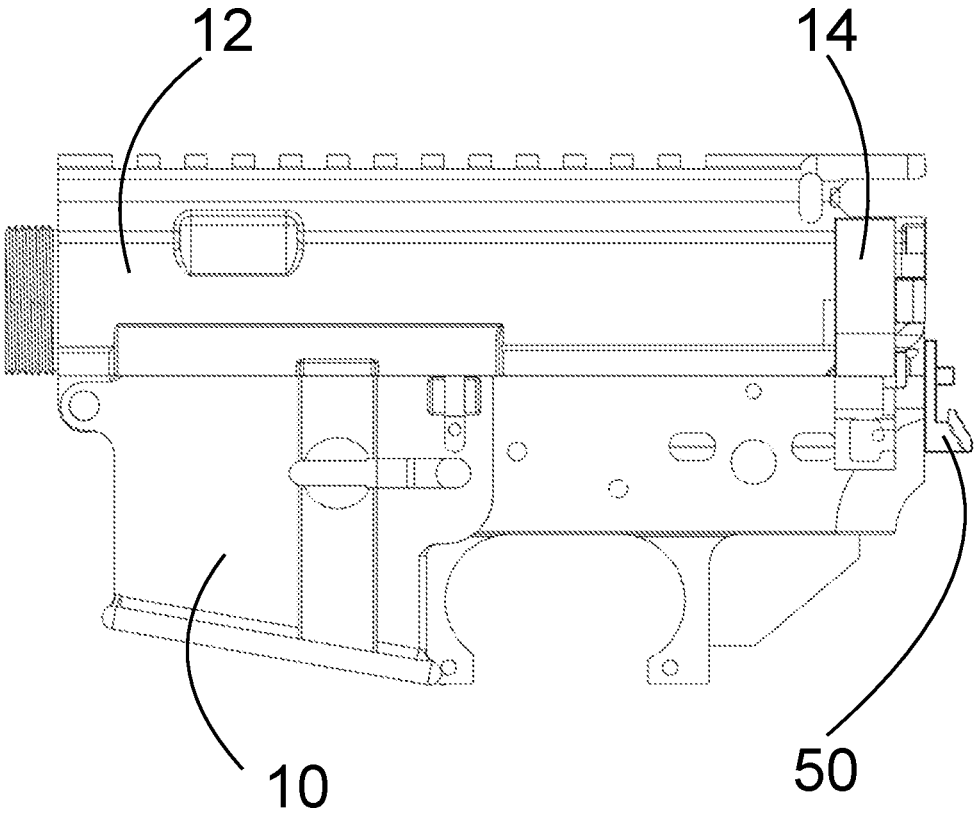
FIG. 4 is a left side elevation view of the Hinged Firearm Receiver with the hinge joint in the open position.

FIG. 3 and FIG. 4 display an embodiment of the Hinge Firearm Receiver 100 form a left side elevation view. FIG. 3 displays an embodiment with the hinge joint in the closed position. FIG. 4 displays an embodiment with the hinge joint in the open position.

Figure 5:
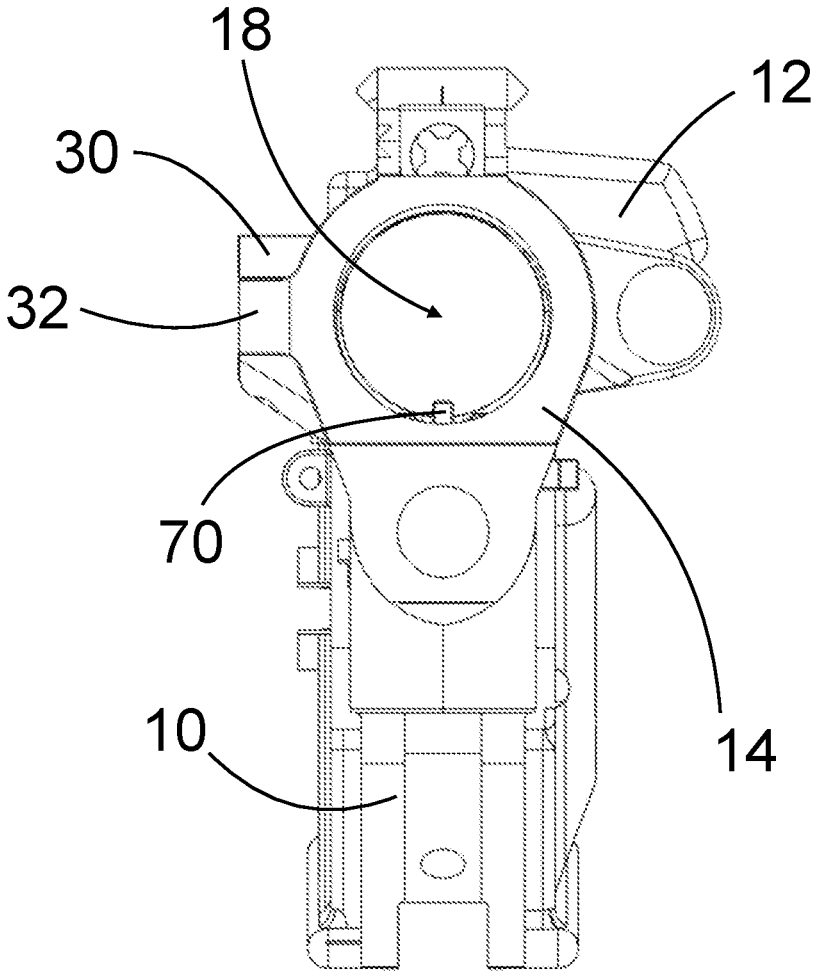
FIG. 5 is a rear elevation view of the Hinged Firearm Receiver with the hinge joint in the closed position.

FIG. 5 displays an embodiment of the Hinge Firearm Receiver 100 from a rear elevation view with the hinge joint in the closed position. The buffer retainer 70 is visible from this view. The buffer retainer 70 is located in the rear receiver and is designed to retain a buffer as displayed in other ar15 patter receivers. Although this embodiment does not display a standard ar15 pattern buffer retainer, a version of an embodiment may be made that does except a standard ar15 pattern buffer retainer.

Figure 6:
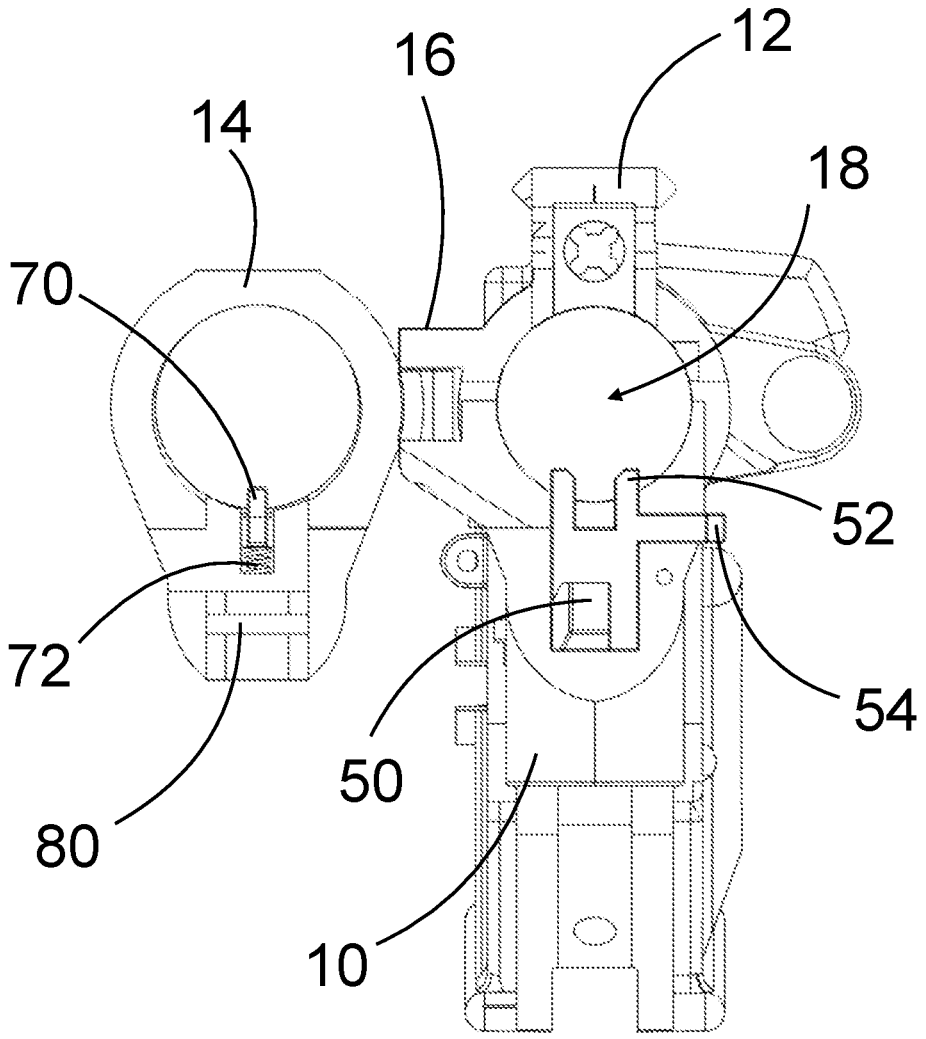
FIG. 6 is a rear elevation view of the Hinged Firearm Receiver with the hinge joint in the open position.

FIG. 6 displays an embodiment of the Hinge Firearm Receiver 100 from a rear elevation view with the hinge joint in the open position. The rear receiver 14 is pivoted offset and to the left of the upper receiver 12. Other embodiments may exist where the hinge joint is located on the right side of the upper receiver 12, in which the rear receiver 14 would pivot to the right of the upper receiver 12. The rear receiver contains the buffer retainer 70 and buffer retainer spring 72. As displayed in other ar15 pattern receivers, this allows the buffer retainer 70 to be pushed downward against the buffer retainer spring 72 to remove a buffer and buffer spring when installed. The latch assembly 50 is in the blocking position. The latch blocking member 52, integral to the latch assembly 50, is sufficiently intruding into the bolt carrier group void circular path 18 to prevent or limit rear travel of the bolt carrier group when installed. The latch blocking member 52 is moved downward out of the bolt carrier group void circular path 18 while the hinge joint is in the closed position. The latch button 54, integral to the latch assembly 50, is available for the operator to push or pull the latch assembly 50 downward in both the hinge joint open position and closed position. Pulling or pushing the latch assembly 50 downward while the hinge joint is in the open position may be used to allow the bolt carrier group to be removed from the upper receiver 12. Pushing or pulling the latch assembly 50 downward while the hinge joint is in the closed position will unlock or release the latch assembly 50 from the locking feature 80, allowing the rear receiver 14 to pivot from the upper receiver 12.

Figure 7:
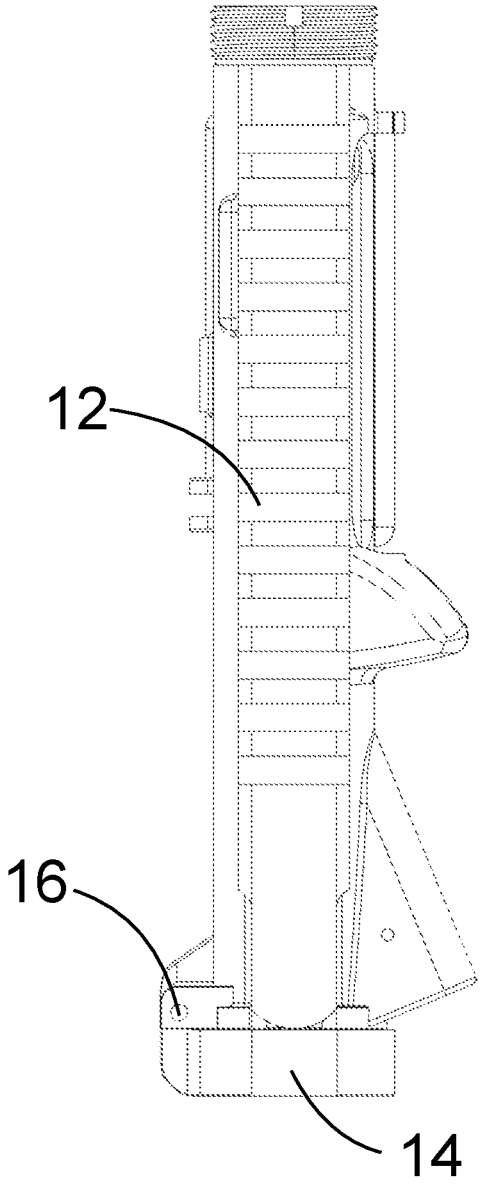
FIG. 7 is a top plane view of the Hinged Firearm Receiver with the hinge joint in the closed position.
Figure 8:
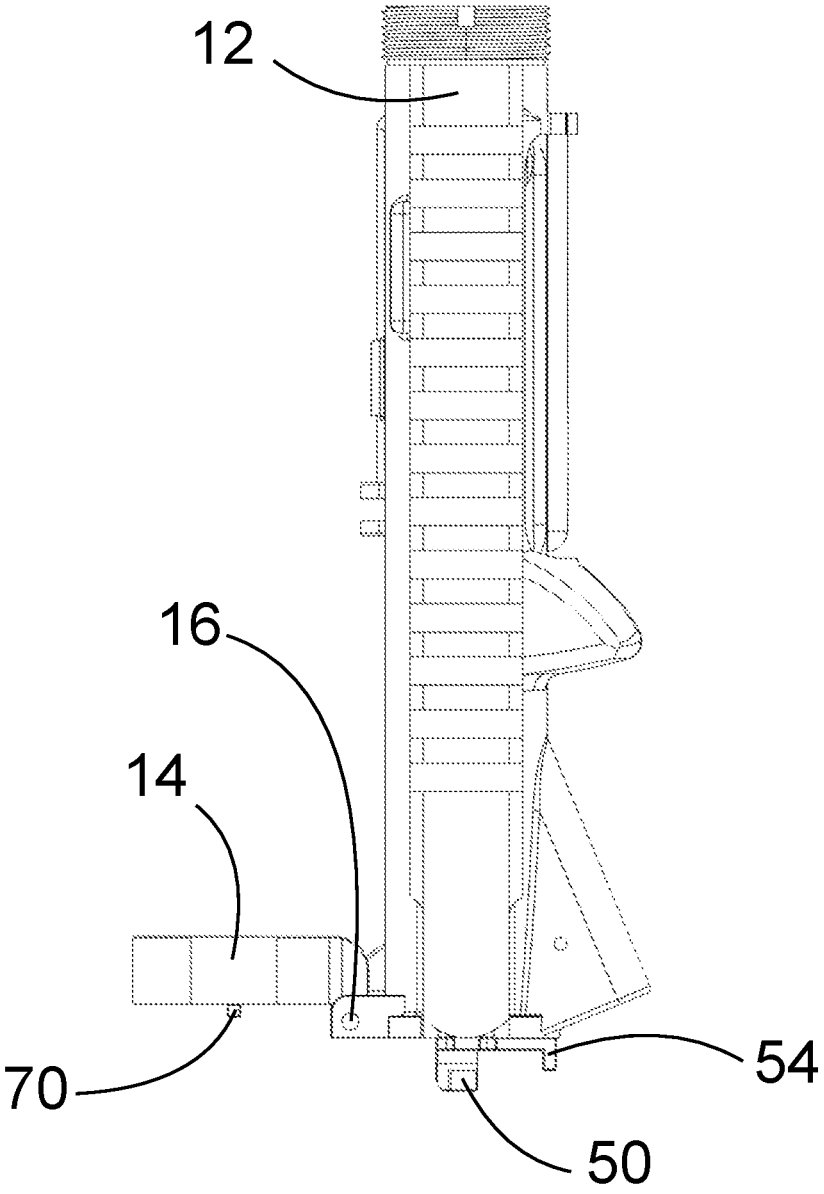
FIG. 8 is a top plane view of the Hinged Firearm Receiver with the hinge joint in the open position.

FIG. 7 and FIG. 8 display an embodiment of the Hinge Firearm Receiver 100 from a top plane view with the hinge joint in the closed position and open position, respectively.

Figure 9:
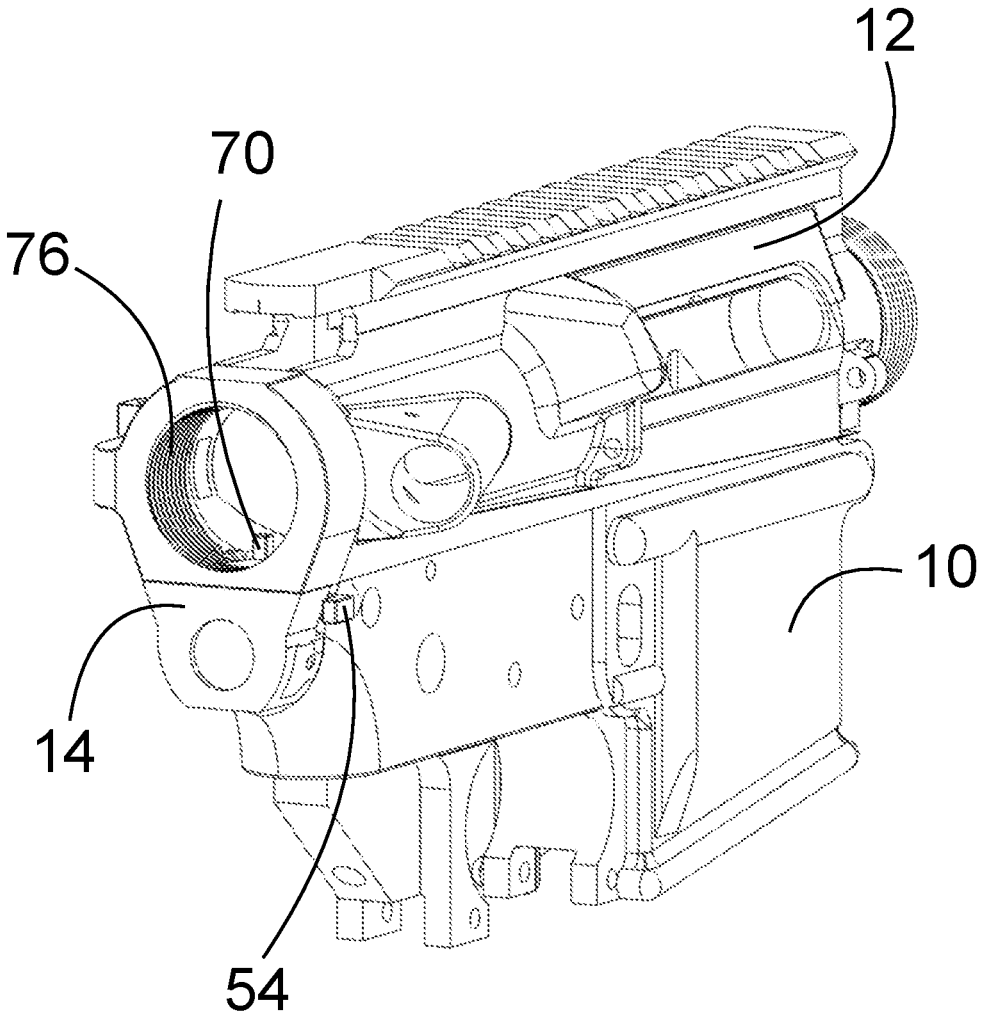
FIG. 9 is a perspective view of the Hinged Firearm Receiver with the hinge joint in the closed position.
Figure 10:
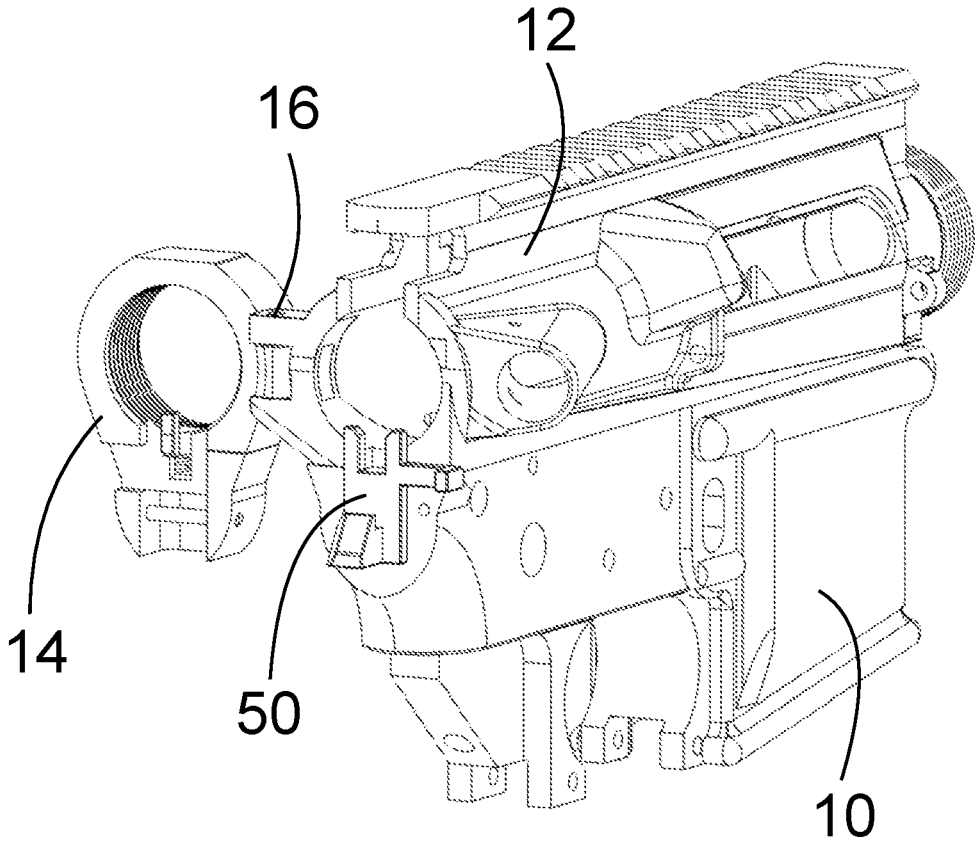
FIG. 10 is a perspective view of the Hinged Firearm Receiver with the hinge joint in the open position.

FIG. 9 and FIG. 10 display an embodiment of the Hinge Firearm Receiver 100 from a rear right perspective view with the hinge joint in the closed position and open position, respectively. Buffer tube receiving thread 76, integral to the rear receiver 14, accept an ar15 pattern buffer tube as common with ar15 pattern receivers. These views display how the latch button 54 is accessible to the operator while the hinge joint is in the closed position.

Figure 11:
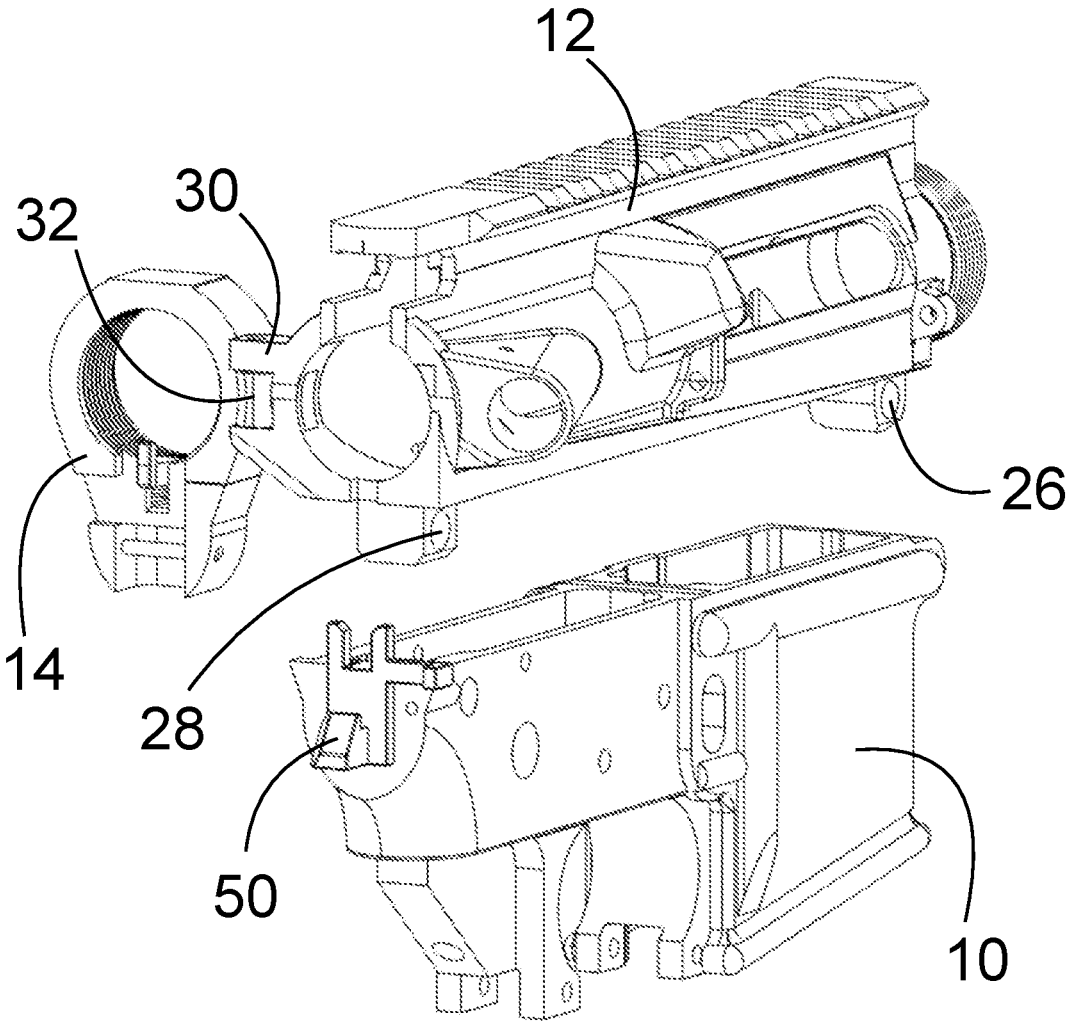
FIG. 11 is an exploded perspective view of the Hinged Firearm Receiver with the hinge joint in the open position.

FIG. 11 displays an exploded perspective view of the Hinge Firearm Receiver 100 with the lower receiver 10 and latch assembly 50 removed from the upper receiver 12 and the rear receiver 14 with the hinge joint in the open position. The upper receiver has an upper rear takedown pin hole 28 and an upper forward takedown pin hole 26 that align with the lower receiver 10 forward takedown pin hole 20 and a rear takedown pin hole 22. This method of aligning a lower receiver with an upper receiver is standard with ar15 pattern receivers.

Figure 12:
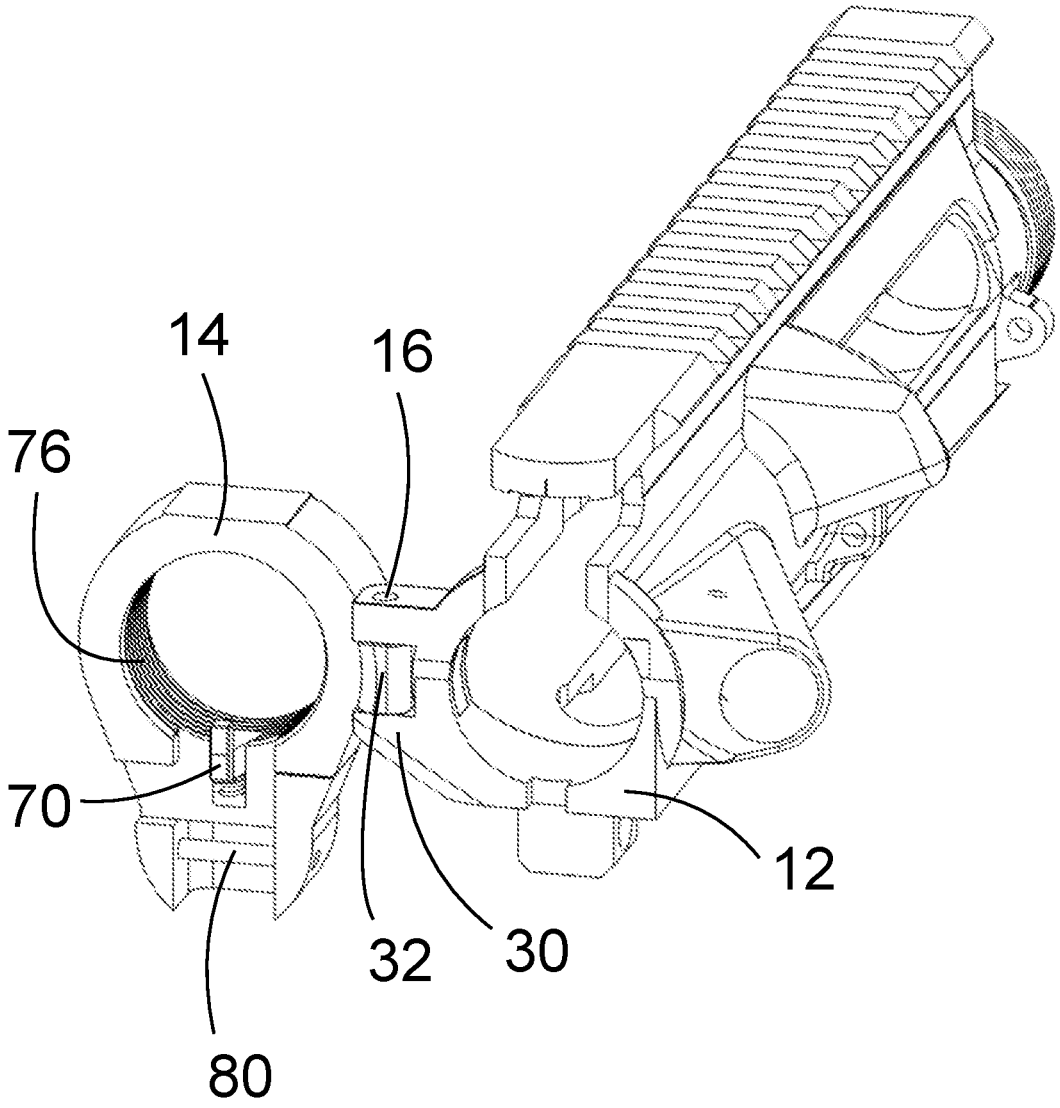
FIG. 12 is a perspective view of the Hinged Firearm Receiver upper receiver and rear receiver with the hinge joint in the open position.

FIG. 12 displays an embodiment of the Hinge Firearm Receiver 100 upper receiver 12 and rear receiver 14 with the hinge joint in the open position.

Figure 13:
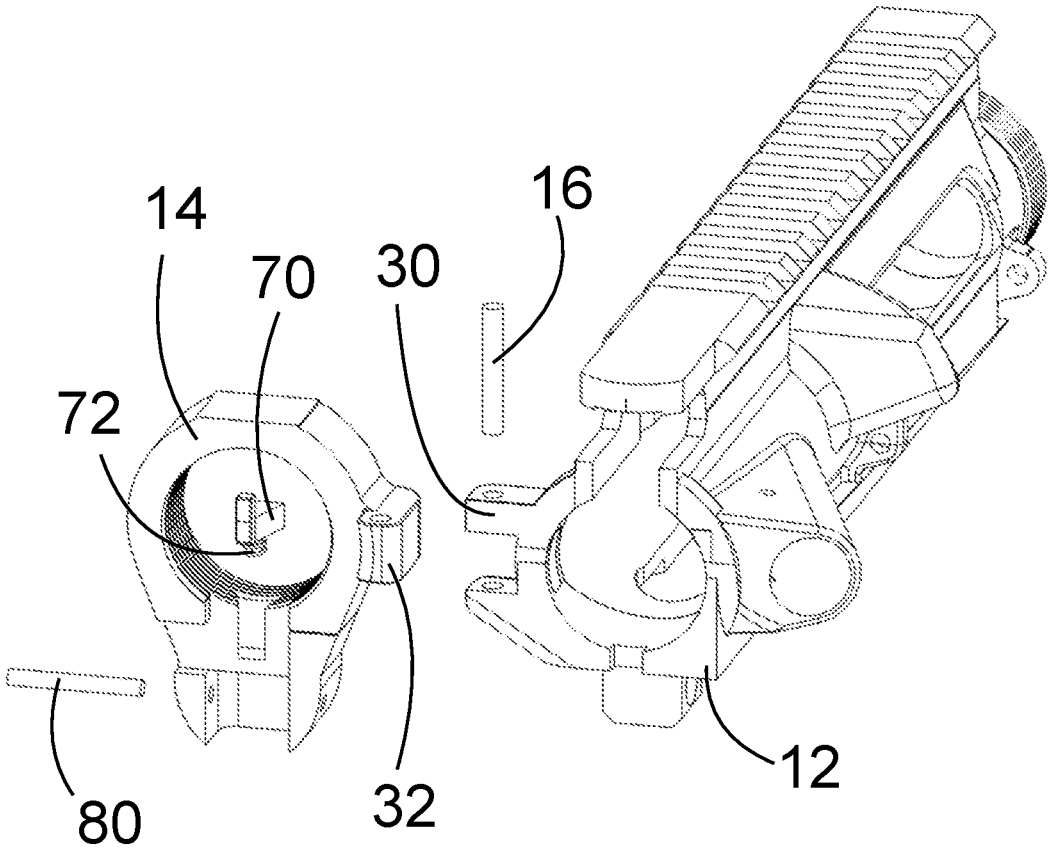
FIG. 13 is an exploded perspective view of the Hinged Firearm Receiver upper receiver and rear receiver.

FIG. 13 displays an exploded view of FIG. 12. In this FIG. the active hinge 32, dead hinge 30, and hinge pivot pin 16, that make up the hinged joint, are dissembled. This allows the upper receiver 12 and the rear receiver 14 to be disconnected from each other. This FIG. also displays the locking feature 80, buffer retainer 70, and buffer retainer spring 72 dissembled from the rear receiver 14.

Figure 14:
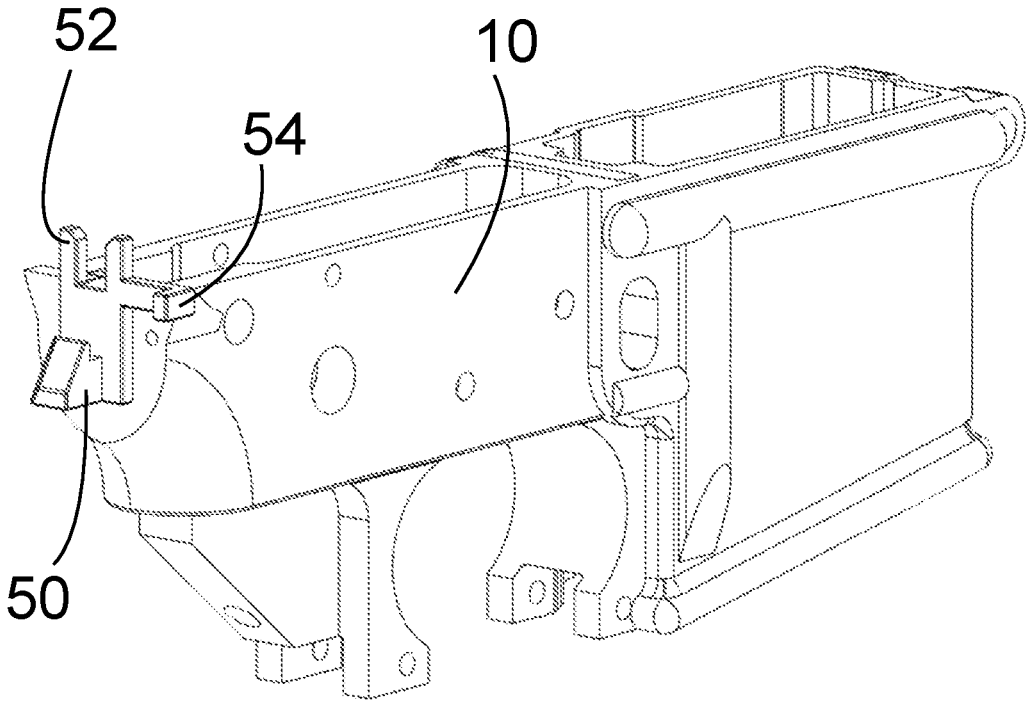
FIG. 14 is a perspective view of the Hinged Firearm Receiver lower receiver and latch assembly.

FIG. 14 displays an embodiment of the Hinge Firearm Receiver 100 lower receiver 10 and latch assembly 50.

Figure 15:
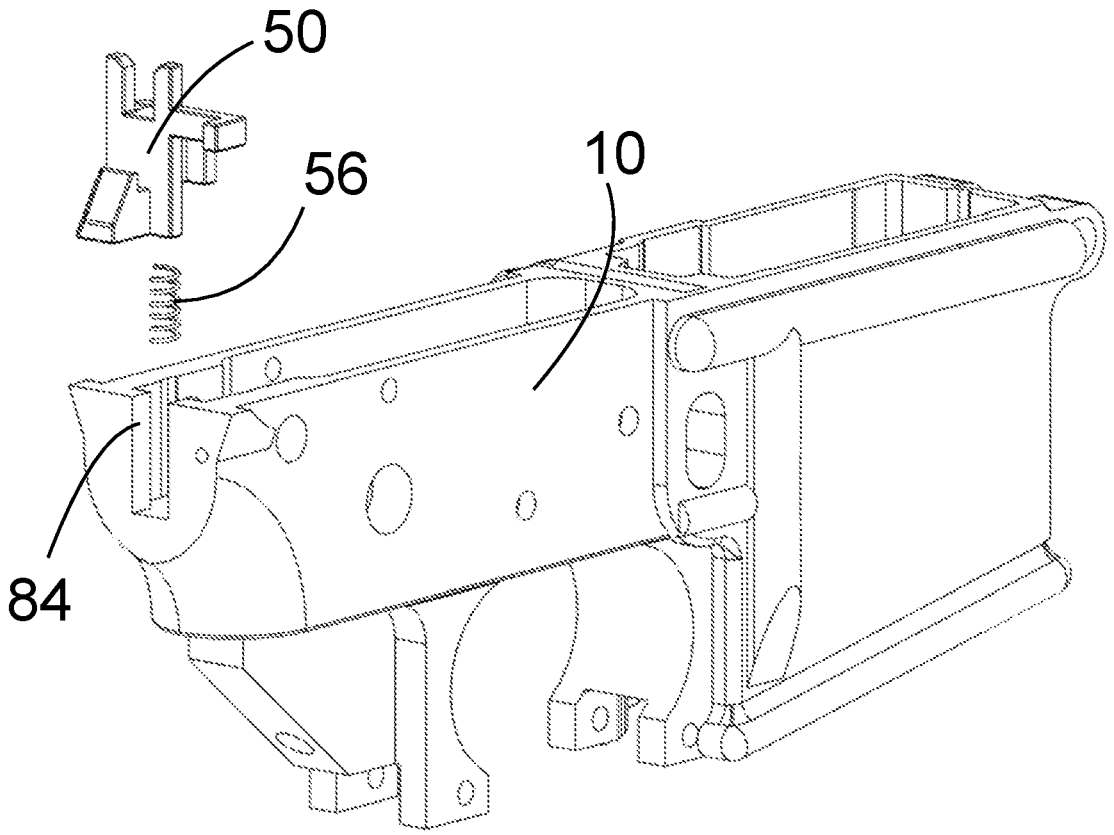
FIG. 15 is an exploded perspective view of the Hinged Firearm Receiver lower receiver and latch assembly.

FIG. 15 displays an exploded view of FIG. 14. This view reveals the receiver rail 84 that accepts the latch assembly 50 and the latch spring 56. The latch spring 56 provides a spring force on the latch assembly 50 against the lower receiver 10. This pushes the latch upward in relation to the lower receiver and provides the Hinged Firearm Receiver 100 with the ability to hold the hinge joint in the closed position.

Figure 16:
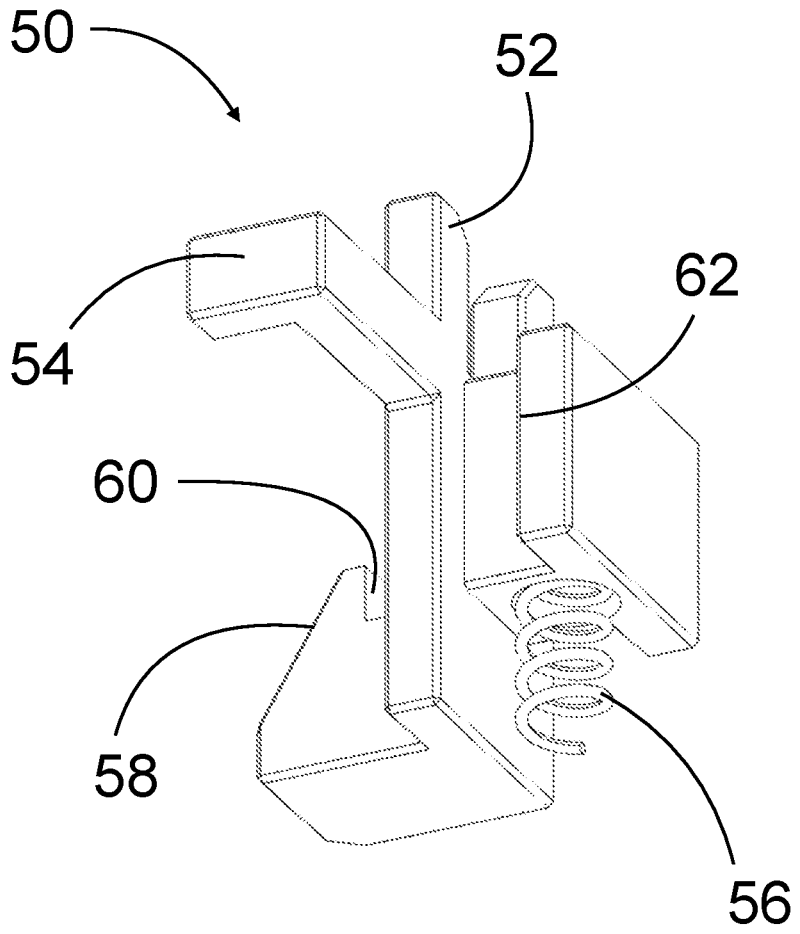
FIG. 16 is a perspective view of the Hinged Firearm Receiver latch assembly.

FIG. 16 is a perspective view of an embodiment of the latch assembly 50. The latch assembly in this embodiment contains many integral elements. The latch spring 56, latch button 54, latch blocking member 52, latch wedge surface 58, latch hold surface 60, and the latch guide rail 62. As stated, the latch spring 56 provides the latch assembly 50 with an upward spring force relative to the lower receiver. The latch button 54 provides the operator with the ability to push or pull the latch down against the spring force when the hinge joint is in the closed position or the open position. This gives the embodiment the ability to unlock the hinge joint from the closed position and move it to the open position. The latch blocking member 52 interrupts the bolt carrier group void circular path 18 in the open hinge joint position and is displaced downward from the bolt carrier group void circular path 18 in the closed hinge joint position. The latch wedge surface 58 is positively sloped relative to the locking feature 80 on the rear receiver 14. When the rear receiver 14 pivots toward the closed position, the locking feature 80 makes contact with the sloped latch wedge surface 58, applying a downward force on the latch, compressing the latch spring 56. As the latch assembly 50 moves downward relative to the rear receiver 14, the locking feature 80 clears the top of the latch wedge surface 58. When the hinge joint is in the closed position the, locking feature 80 clears the latch hold surface 60. At this point the latch, no longer having the locking feature 80 pushing down on the latch wedge surface 58, moves upward so that the latch hold surface 60 is directly behind the locking feature 80, which prevents the hinge joint from pivoting out of the closed position. To allow the hinge joint to pivot back into the open position, the operator may push or pull down on the latch button 54 to compress the latch spring 56 to move the latch hold surface 60 below the locking feature 80, freeing the rear receiver 14 to pivot away from the latch assembly 50, the upper receiver 12, and lower receiver 10. The combination of features in the latch assembly 50 allow the operator to move the hinge joint from the open position to the closed position with the latch holding it in the closed position automatically. The operator then must release the hold by pressing or pulling the latch button 54 downward to pivot the hinge joint from the closed to the open position. The latch guide rail 62, in combination with the receiver rail 84, ensures the latch assembly has support to move up and down and to prevent other unwanted shifting, front, back, left, and or right movements in this embodiment.

Figure 17:
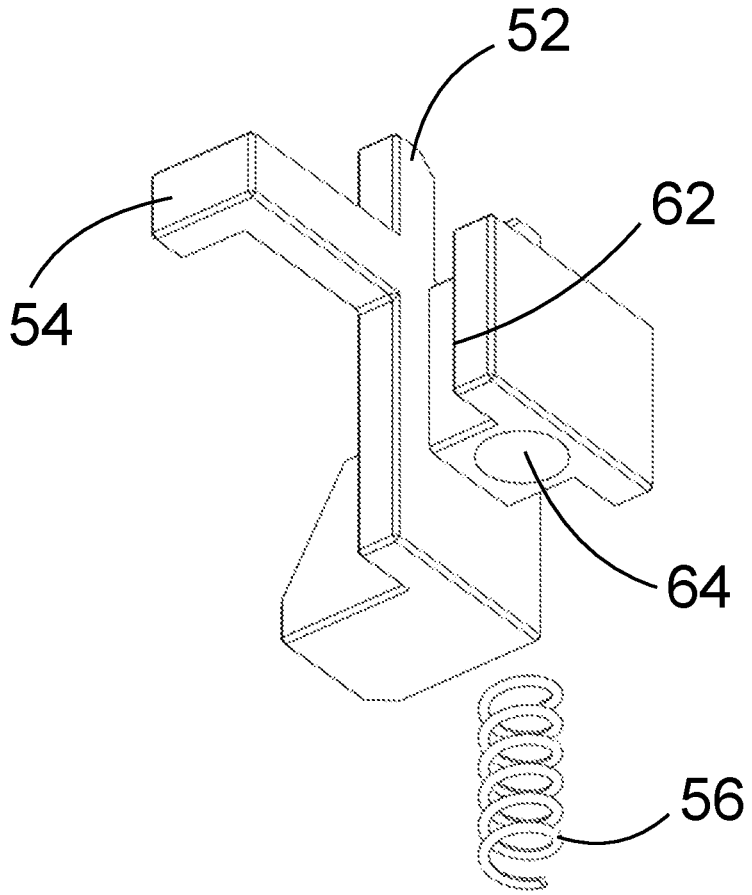
FIG. 17 is an exploded perspective view of the Hinged Firearm Receiver latch assembly.
Figure 18:
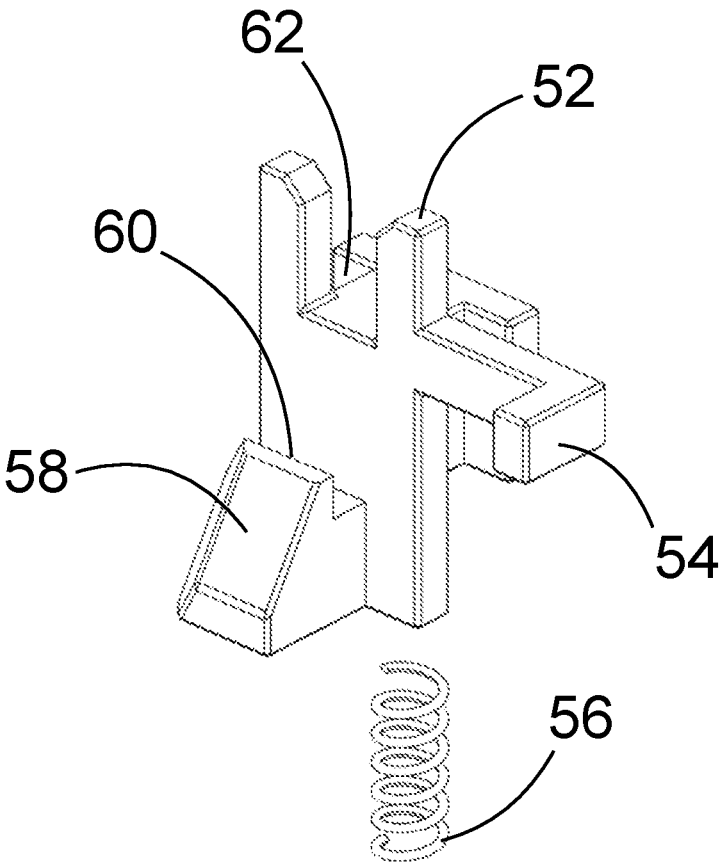
FIG. 18 is an exploded perspective view of the Hinged Firearm Receiver latch assembly.

FIG. 17 and FIG. 18 are exploded and alternative views of FIG. 16. The latch spring 56 fits inside the latch spring hole 64.

Figure 19:
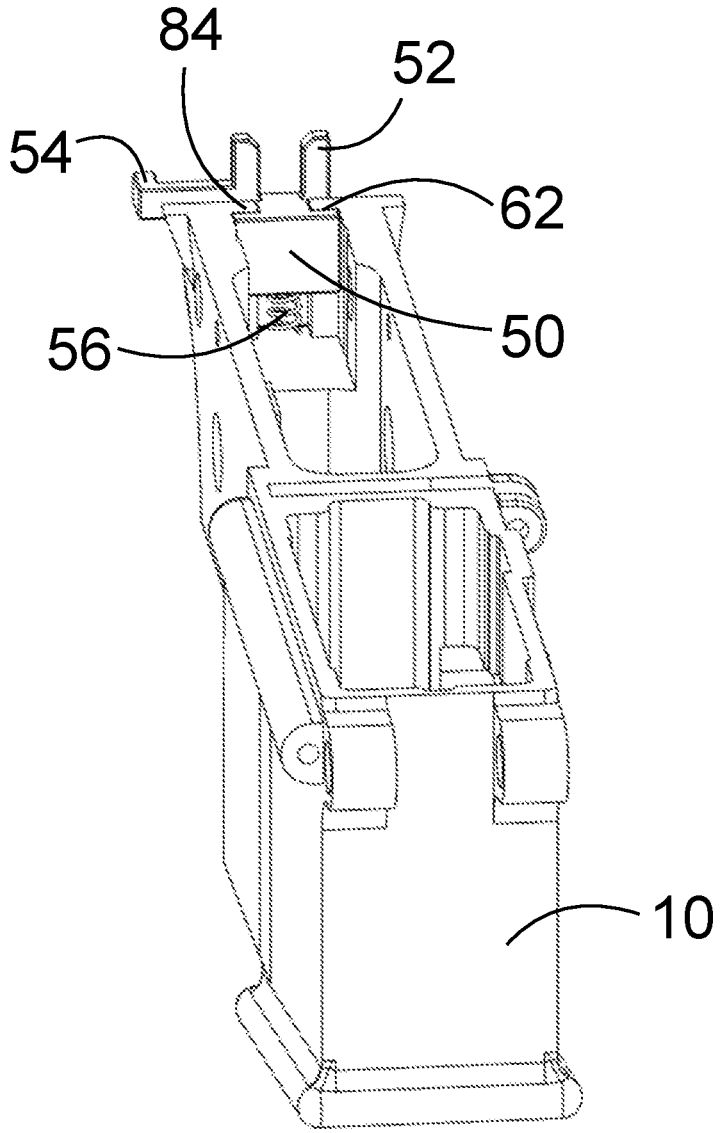
FIG. 19 is a perspective view of the Hinged Firearm Receiver lower receiver and latch assembly in blocking position.
Figure 20:
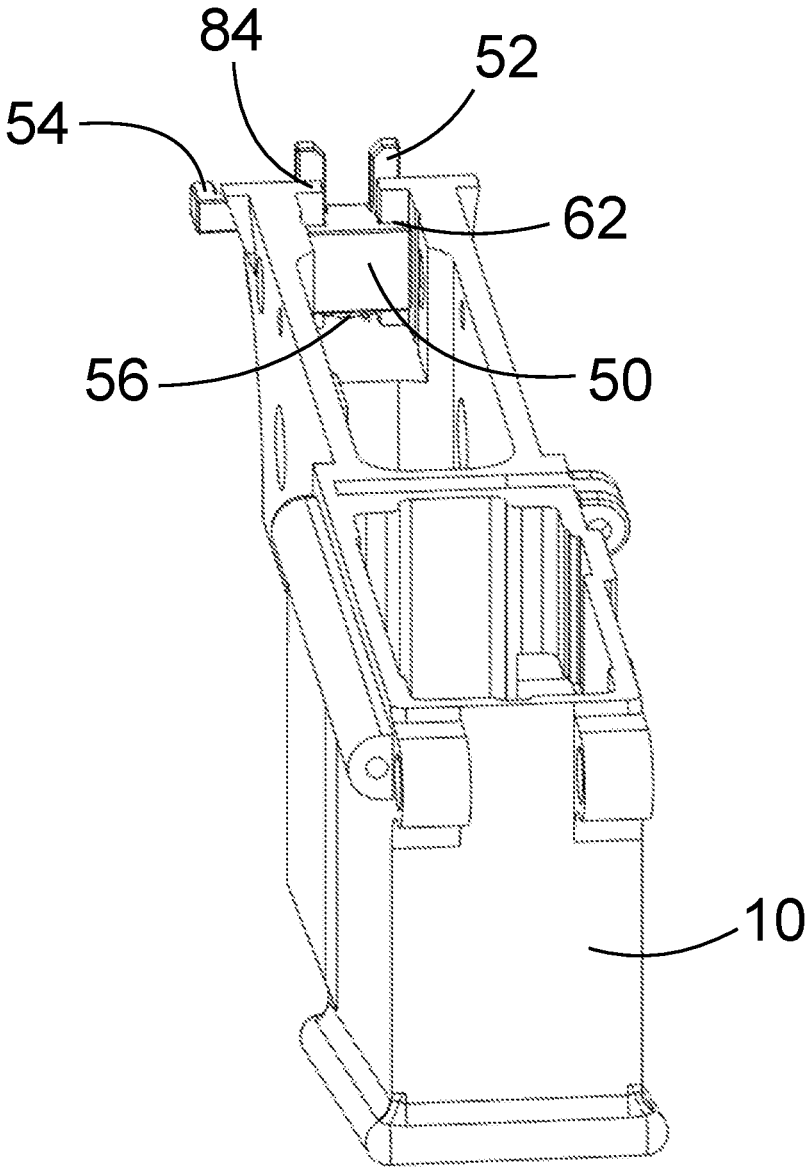
FIG. 20 is a perspective view of the Hinged Firearm Receiver lower receiver and latch assembly in locked position.

FIG. 19 and FIG. 20 display an embodiment of the lower receiver 10 and the latch assembly 50 assembled. FIG. 19 displays the latch spring 56 in a low compression state, with the latch assembly 50 in the blocking position. FIG. 20 displays the latch spring 56 in a high compression state, with the latch assembly 50 in the locked position. The latch guide rail 62 interlocks with the receiver rail 84 to provide proper vertical movement of the latch assembly 50 and to remove unwanted non-vertical movement of the latch assembly 50 relative to the lower receiver 10.

Figure 21:
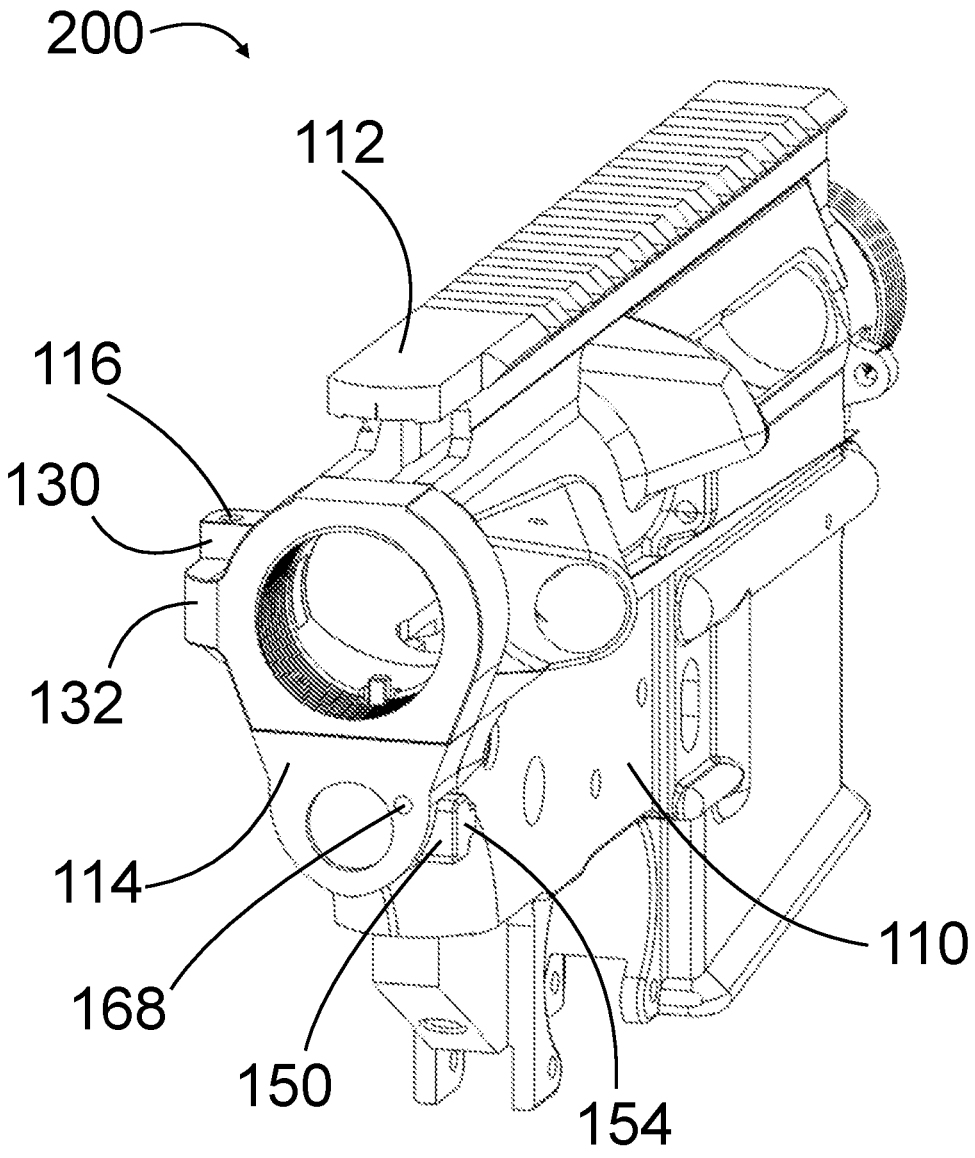
FIG. 21 is a perspective view of the Hinged Firearm Receiver with the hinge joint in the closed position.

FIG. 21 displays an embodiment of a Hinged Firearm Receiver 200, with a Lower receiver 110, an upper receiver 112, a dead hinge section 130 integral to the upper receiver 112, a rear receiver 114, a active hinge section 132 integral to the rear receiver 114, a hinge pivot pin 116 that creates a hinge joint with the active hinge section 132 and the dead hinge section 130 with an open position and closed position, a latch assembly 150 located in the rear receiver 114, a latch button 154 integral to the latch assembly 150 available for the operator to push inward to unlock the hinge joint from the closed position and pivot the hinge joint to the open position. FIG. 21 displays the embodiment with the hinge joint in the closed position.

Figure 22:
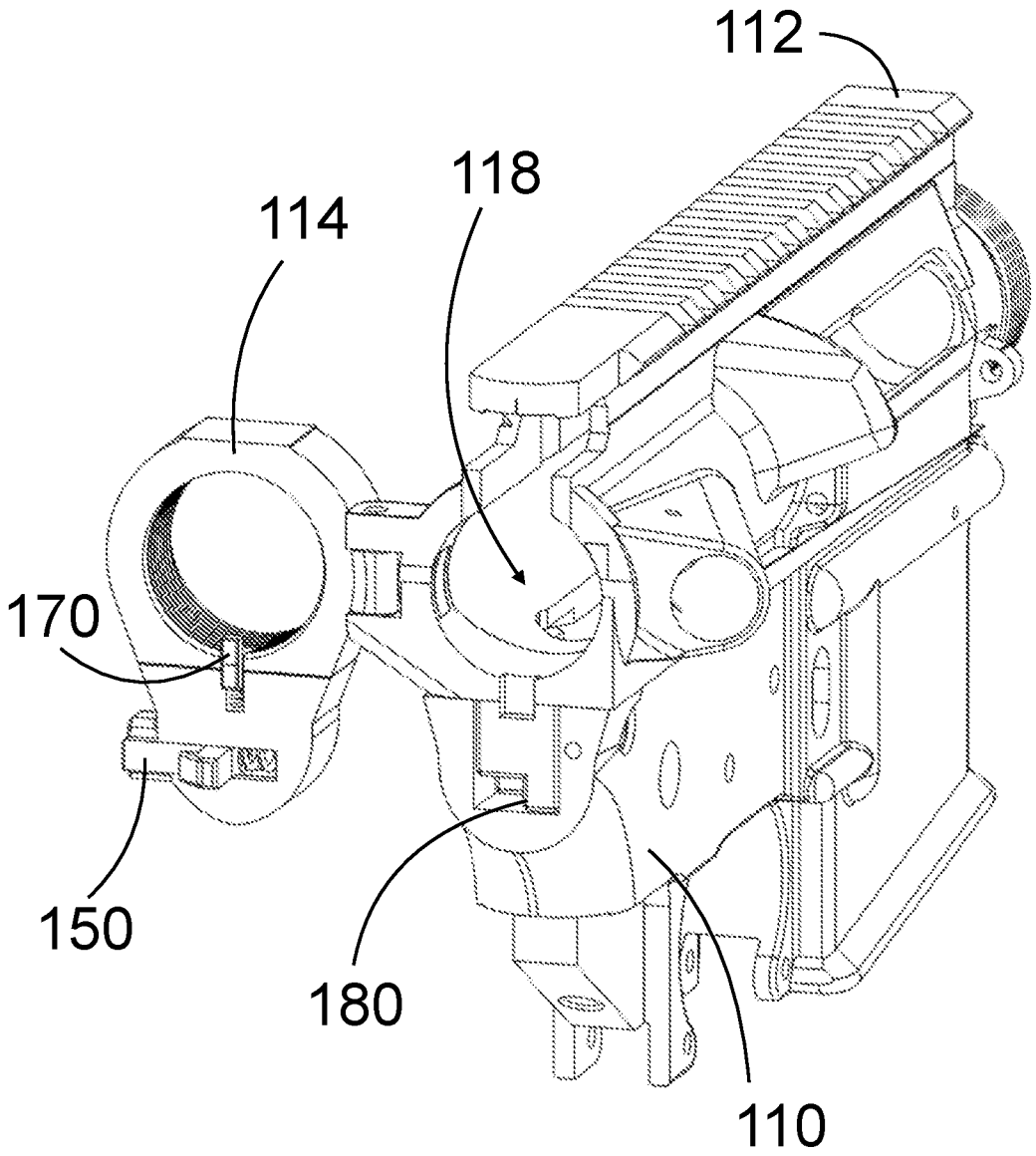
FIG. 22 is a perspective view of the Hinged Firearm Receiver with the hinge joint in the open position.

FIG. 22 displays the same embodiment as FIG. 21 with the hinge joint in the open position. The Active hinge section 132 integral to the rear receiver 114 pivots on the hinge pivot pin 116 from the closed position, which is significantly inline with the upper receiver 112 to the open position that is offset from the upper receiver 112. Both the latch assembly 150 and the buffer retainer 170 are locating within the rear receiver 114. The locking feature 180 is located on the upper receiver 112. This embodiment is unique because a majority of the recoil forces are supported by the upper receiver 112. This allows the lower receiver 110 to be made lighter with less material or a different materials, like polymer.

Figure 23:
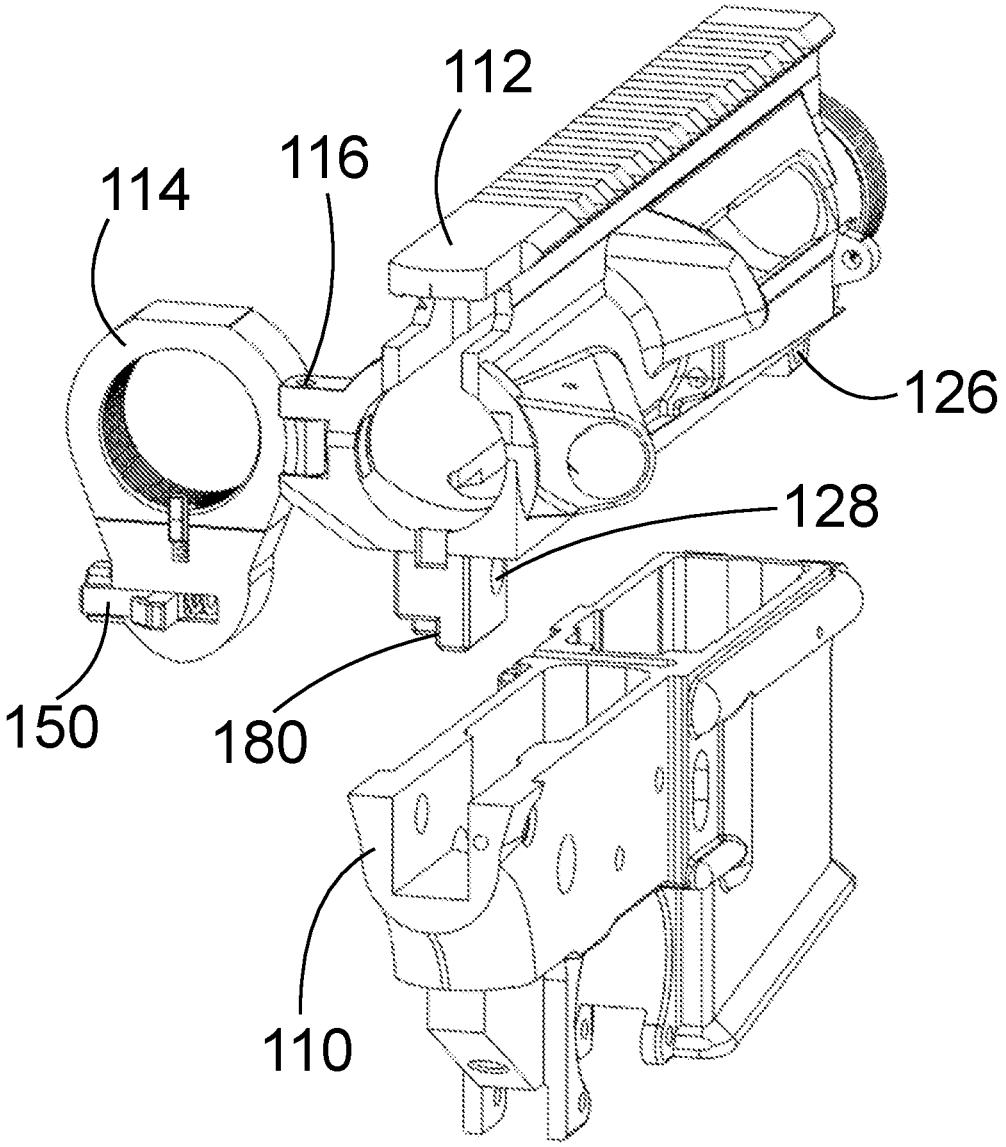
FIG. 23 is an exploded perspective view of the Hinged Firearm Receiver with the hinge joint in the open position.

FIG. 23 displays an exploded perspective view of the Hinge Firearm Receiver 200 with the lower receiver 110 removed from the upper receiver 112 and the rear receiver 114 with the hinge joint in the open position. The upper receiver has an upper rear takedown pin hole 128 and an upper forward takedown pin hole 126 that align with the lower receiver 110 forward takedown pin hole and rear takedown pin hole not labeled in the drawings but similar to that of the previous embodiment. This method of aligning the lower receiver with the upper receiver is standard with AR-pattern receivers.

Figure 24:
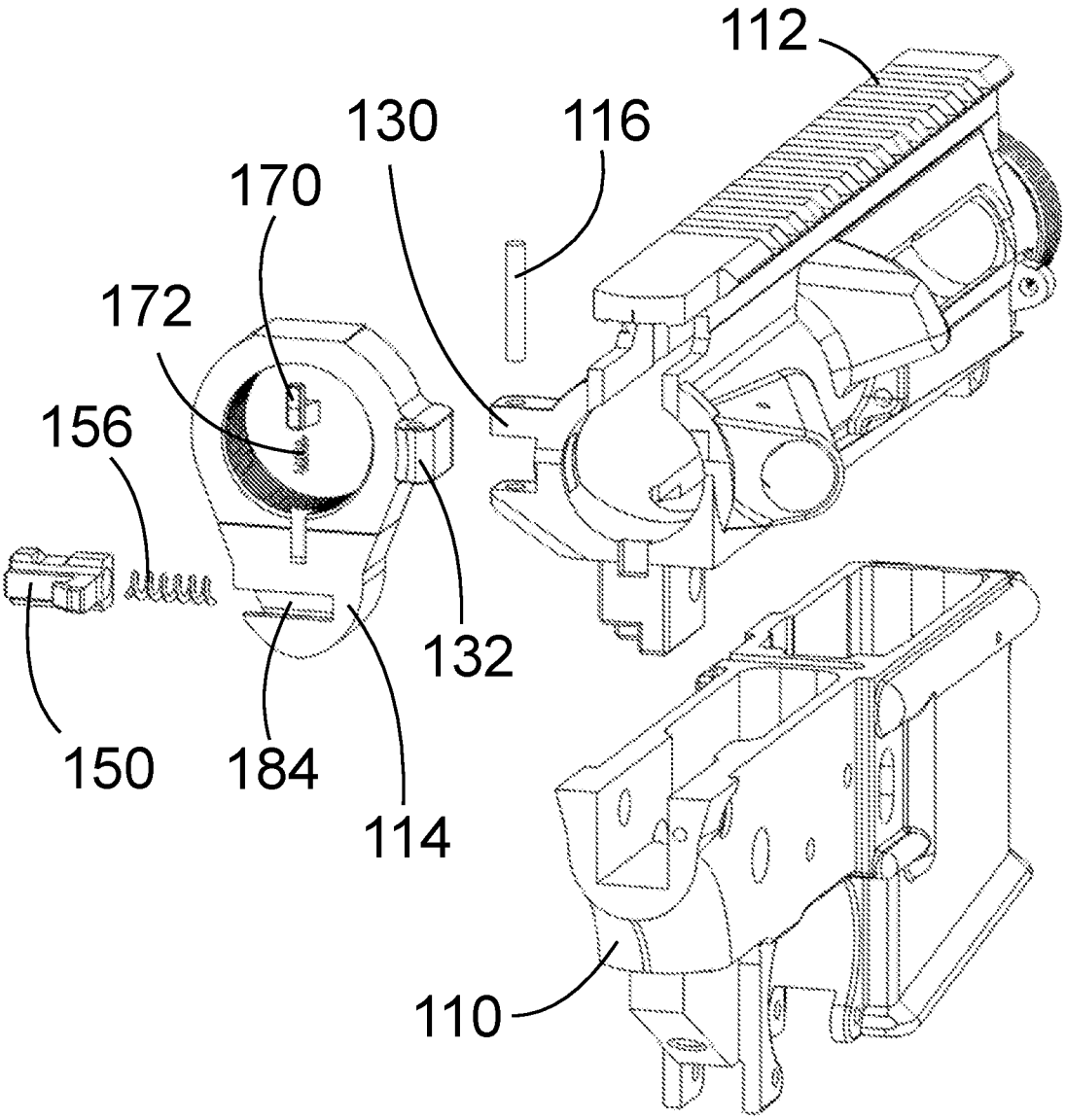
FIG. 24 is an exploded perspective view of the Hinged Firearm Receiver.

FIG. 24 displays an exploded perspective view of the Hinge Firearm Receiver 200 with the lower receiver 110, the upper receiver 112, the rear receiver 114, the latch assembly 150, the latch spring 156, the buffer retainer 170, the buffer retainer spring 172, and the hinge pivot pin 116 dissembled. Additionally, the latch receiver guide 184 is displayed integral to the rear receiver 114, and is responsible for ensuring the latch can move appropriately to function as a hold and release for the closed position of the hinge joint, as well as a shoulder for the latch spring 156 to push against.

Figure 25:
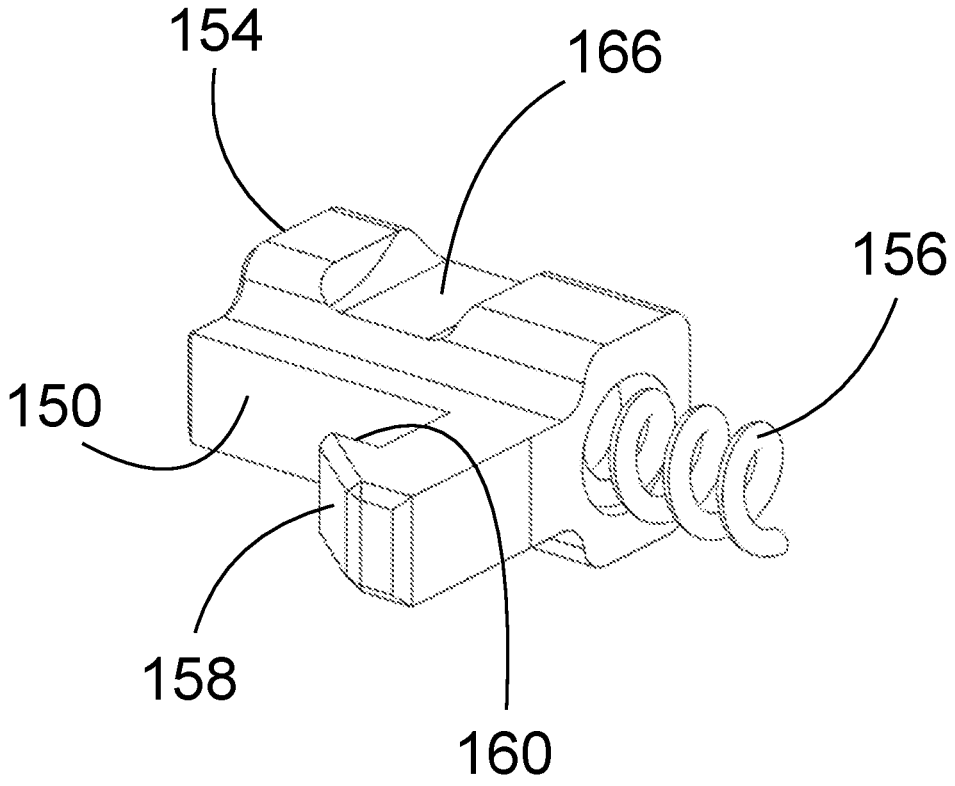
FIG. 25 is a perspective view of the Hinged Firearm Receiver latch assembly.

FIG. 25 is a perspective view that displays the latch assembly 150 of the embodiment 200, with many integral features, similar to the previous embodiment. The latch spring 156, latch button 154, latch wedge surface 158, latch hold surface 160, and the latch retaining notch 166. The latch retaining notch 166 in conjuncture with the latch retaining pin 168 prevents the latch assembly from falling out of the rear receiver 114.

Figure 26:
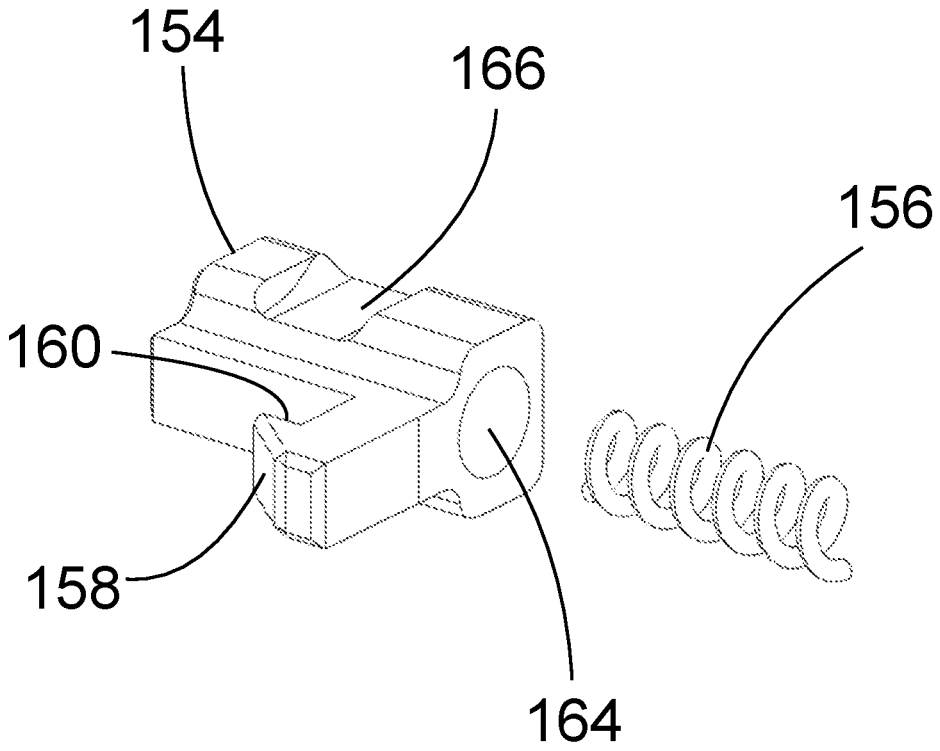
FIG. 26 is an exploded perspective view of the Hinged Firearm Receiver latch assembly.
Figure 27:
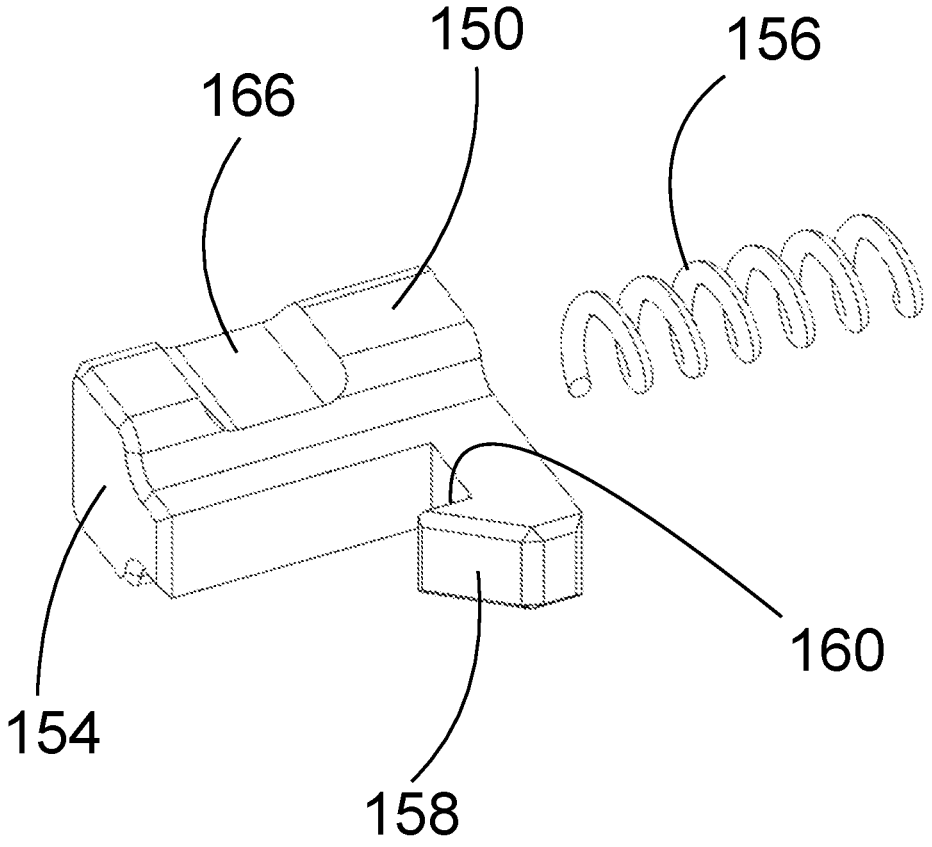
FIG. 27 is an exploded perspective view of the Hinged Firearm Receiver latch assembly.

FIG. 26 and FIG. 27 display an exploded perspective and alternative views of FIG. 25. The latch spring hole 164 holds the latch spring 156 inside.

Figure 28:
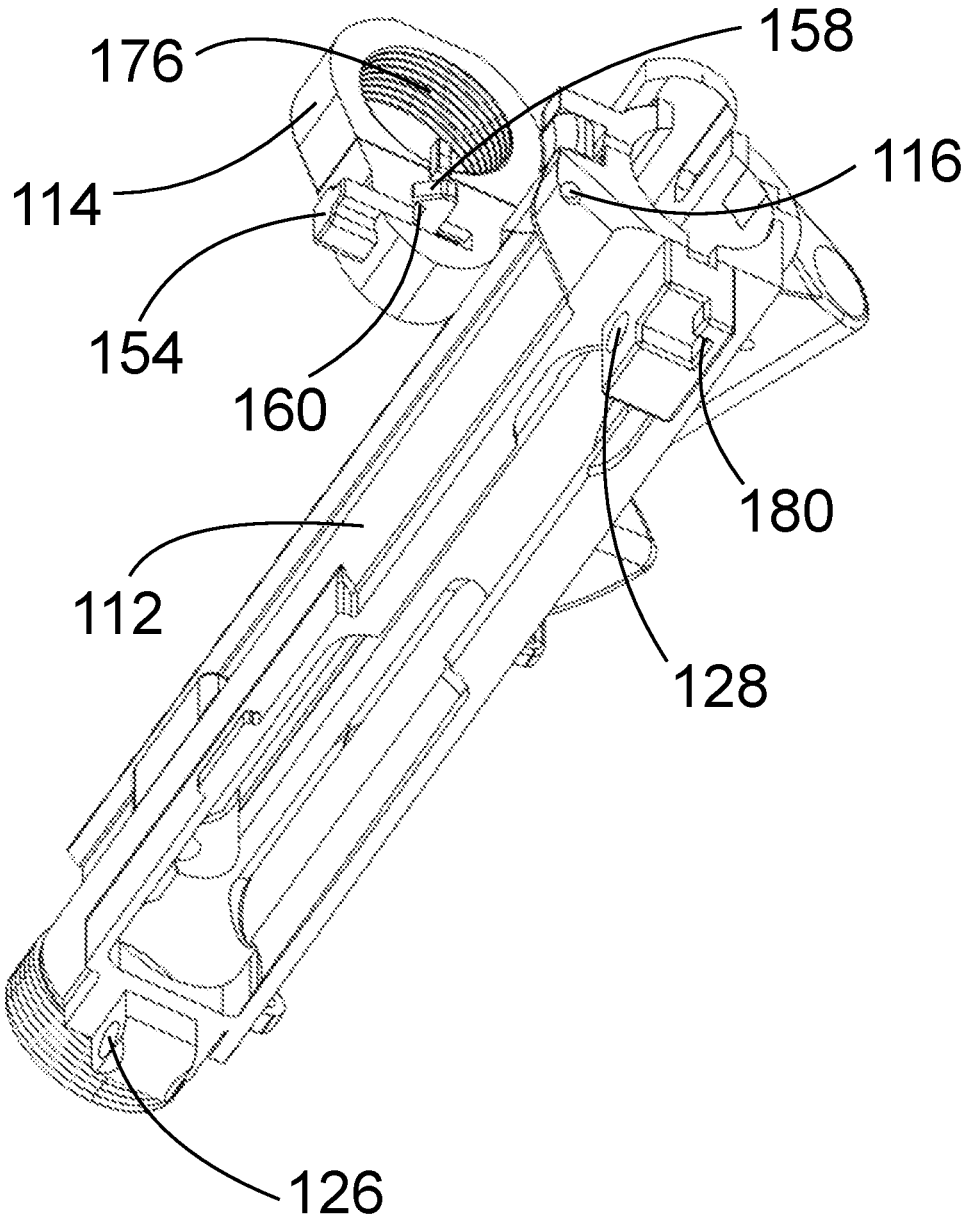
FIG. 28 is a perspective view of the Hinged Firearm Receiver upper receiver and rear receiver with the hinge joint in the open position.

FIG. 28 displays a perspective view of the upper receiver 112 and the rear receiver 114. Buffer tube receiving thread 176 are integral to the rear receiver 114, similar to the previous embodiment.

Figure 29:
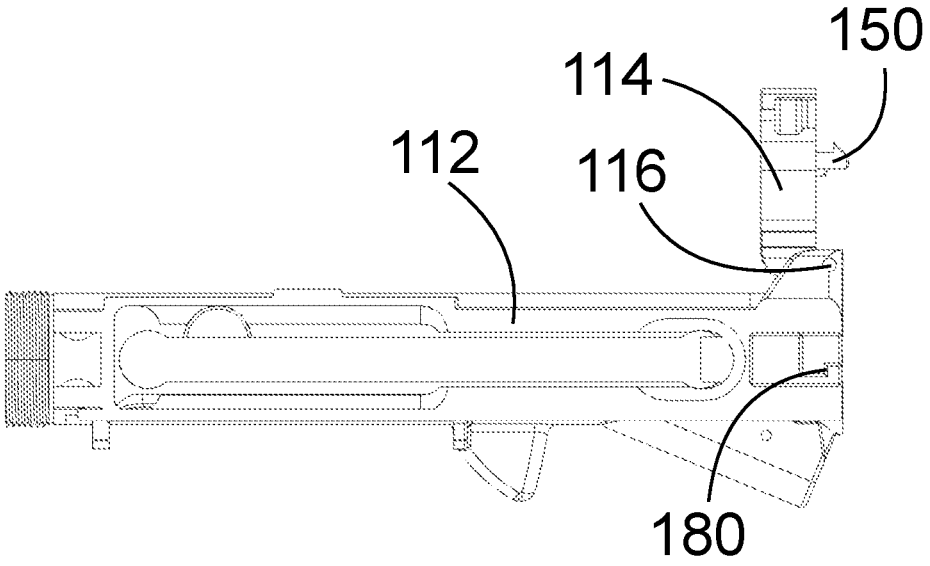
FIG. 29 is a bottom plane view of the Hinged Firearm Receiver upper receiver and rear receiver with the hinge joint in the open position.
Figure 30:
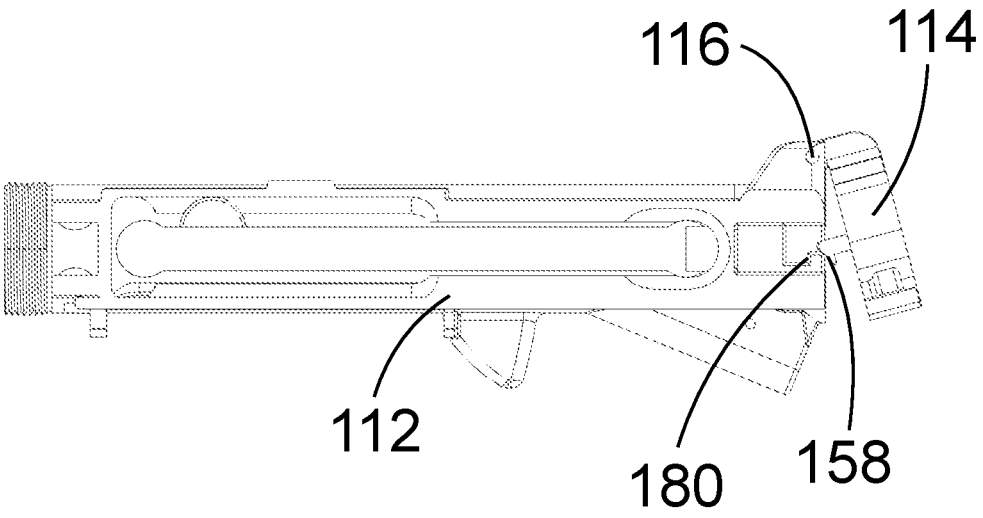
FIG. 30 is a bottom plane view of the Hinged Firearm Receiver upper receiver and rear receiver with the hinge joint in between the open and closed position.
Figure 31:
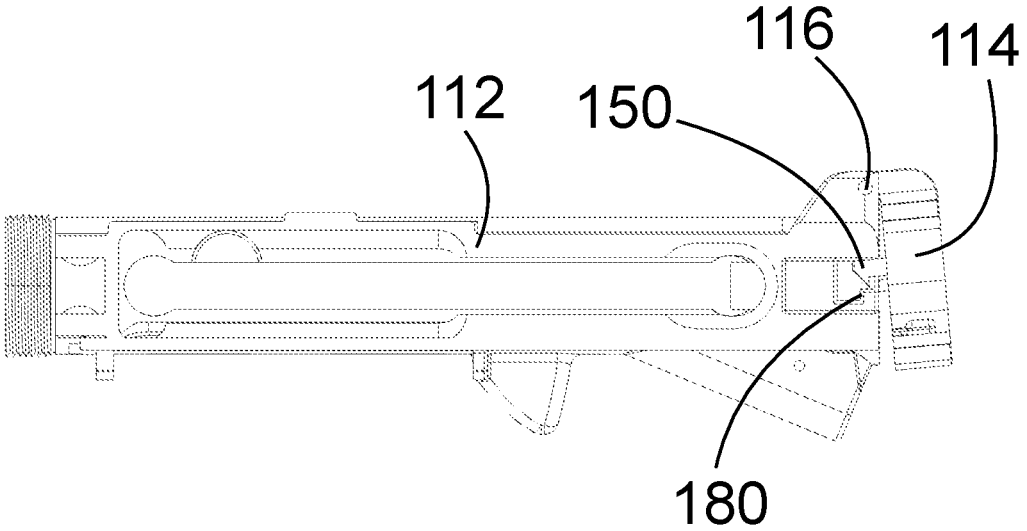
FIG. 31 is a bottom plane view of the Hinged Firearm Receiver upper receiver and rear receiver with the hinge joint in between the open and closed position.
Figure 32:
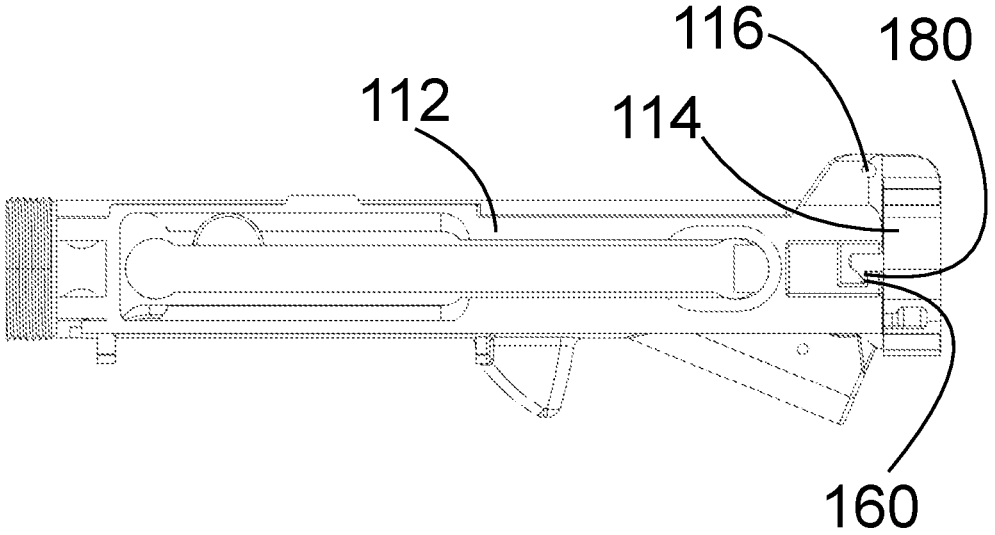
FIG. 32 is a bottom plane view of the Hinged Firearm Receiver upper receiver and rear receiver with the hinge joint in the closed position.

FIGS. 29 through 32 display a bottom plane view of how the rear receiver 114 pivots from the hinge joint open position to the closed position in an embodiment. FIG. 29 displays a starting open position. FIG. 30 displays a moment the latch wedge surface 158 comes in contact with the locking feature 180 integral to the upper receiver 112. FIG. 31 displays the latch assembly 150 pushed inward so that it clears the locking feature 180. FIG. 32 displays the hinge joint in the closed position. The latch spring 156 has pushed the latch assembly 150 outward into the locked position. The latch hold surface 160 has cleared the locking feature 180 and the two surfaces are now in contact. The hinge joint may not pivot from the closed position to the open position unless the operator pushes the latch button 154 inward, compressing the latch spring 156, so that the latch hold surface 160 clears the locking feature 180.

Figure 33:
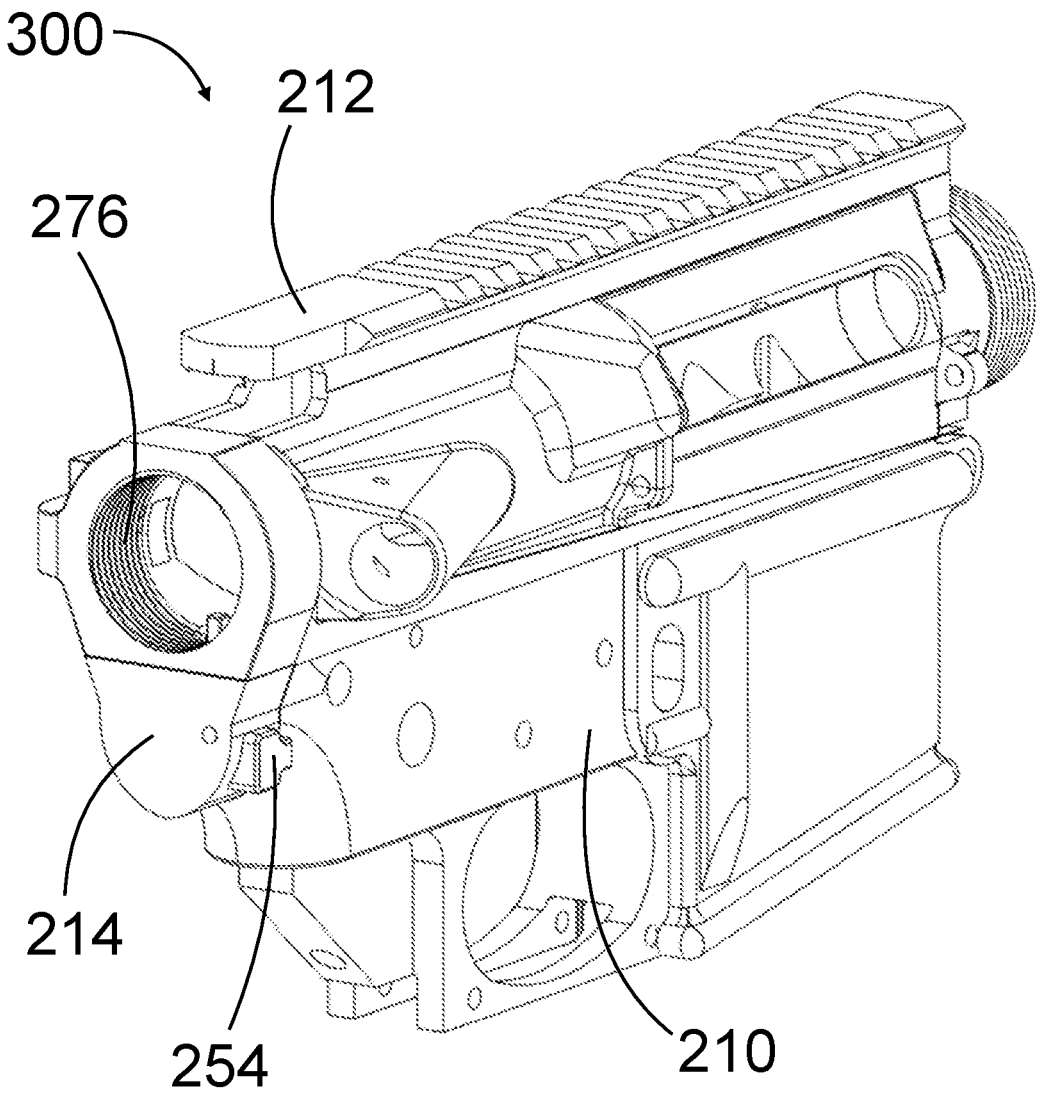
FIG. 33 is a perspective view of the Hinged Firearm Receiver with the hinge joint in the closed position.

FIG. 33 display a perspective view of an embodiment of a Hinged Firearm Receiver 300, with a Lower receiver 210, an upper receiver 212, a dead hinge section 230 integral to the upper receiver 212, a rear receiver 214, a active hinge section 232 integral to the rear receiver 214, a hinge pivot pin 216 that creates a hinge joint with the active hinge section 232 and the dead hinge section 230 with an open and closed position, a latch assembly 250 located in the rear receiver 214, a latch button 254 integral to the latch assembly 250 available for the operator to push inward to unlock the hinge joint from the closed position and pivot the hinge joint to the open position. FIG. 33 displays the embodiment with the hinge joint in the closed position. Buffer tube receiving thread 276 are integral to the rear receiver 214 and accept standard ar15 pattern buffer tubes.

Figure 34:
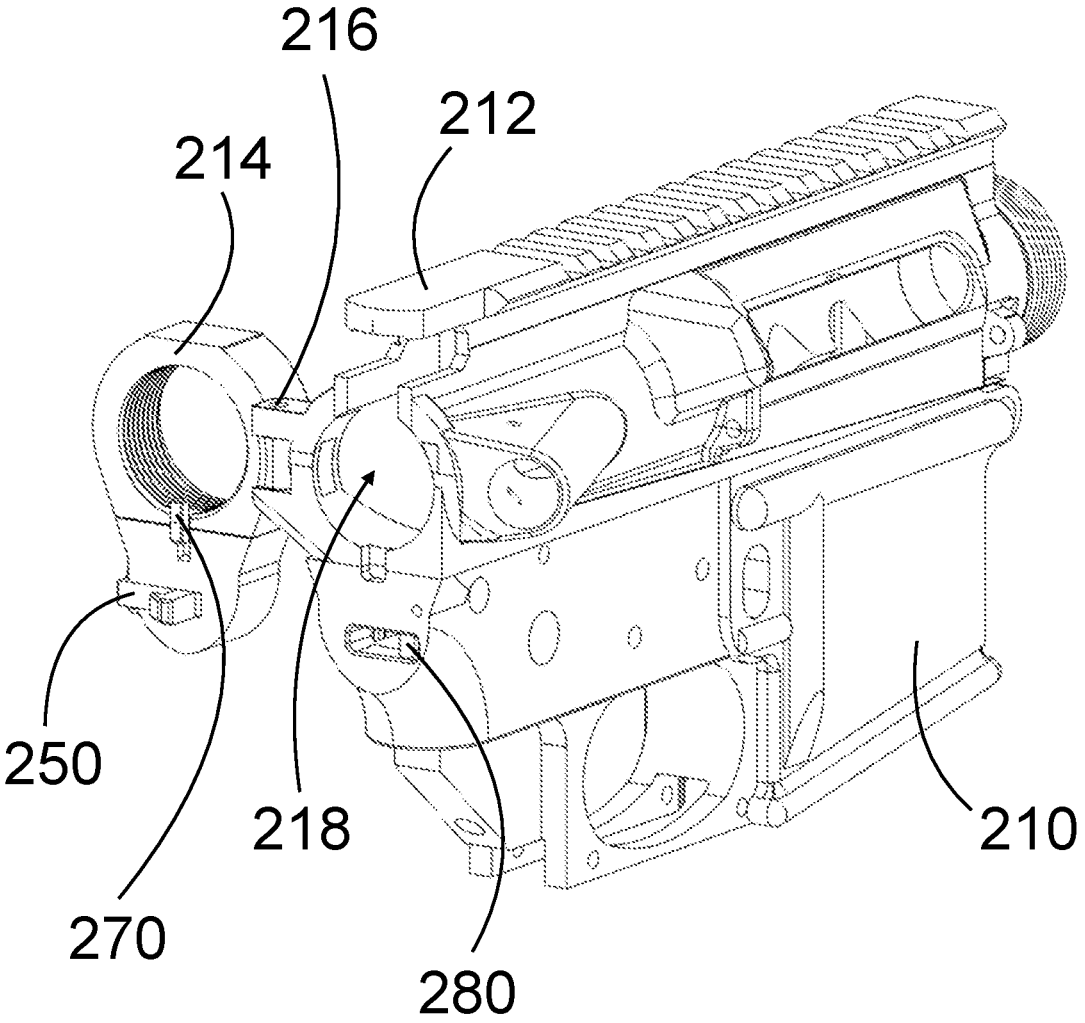
FIG. 34 is a perspective view of the Hinged Firearm Receiver with the hinge joint in the open position.

FIG. 34 displays a perspective view of an embodiment of a Hinged Firearm Receiver 300 with the hinged joint in the open position. This embodiment includes a buffer retainer 270 located in the rear receiver 214 and a bolt carrier group void circular path 218, similar to previous embodiments.

Figure 35:
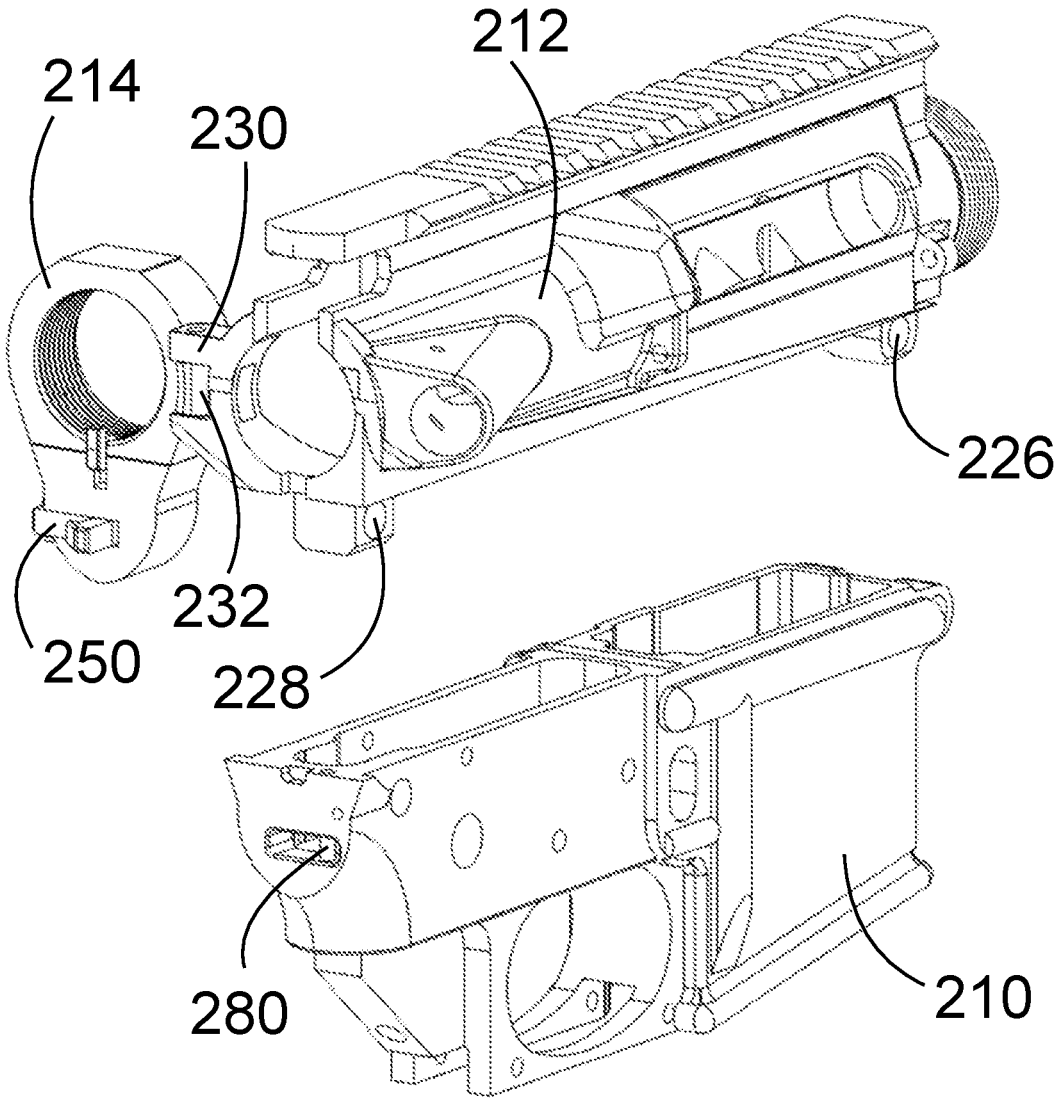
FIG. 35 is an exploded perspective view of the Hinged Firearm Receiver with the hinge joint in the open position.
Figure 36:
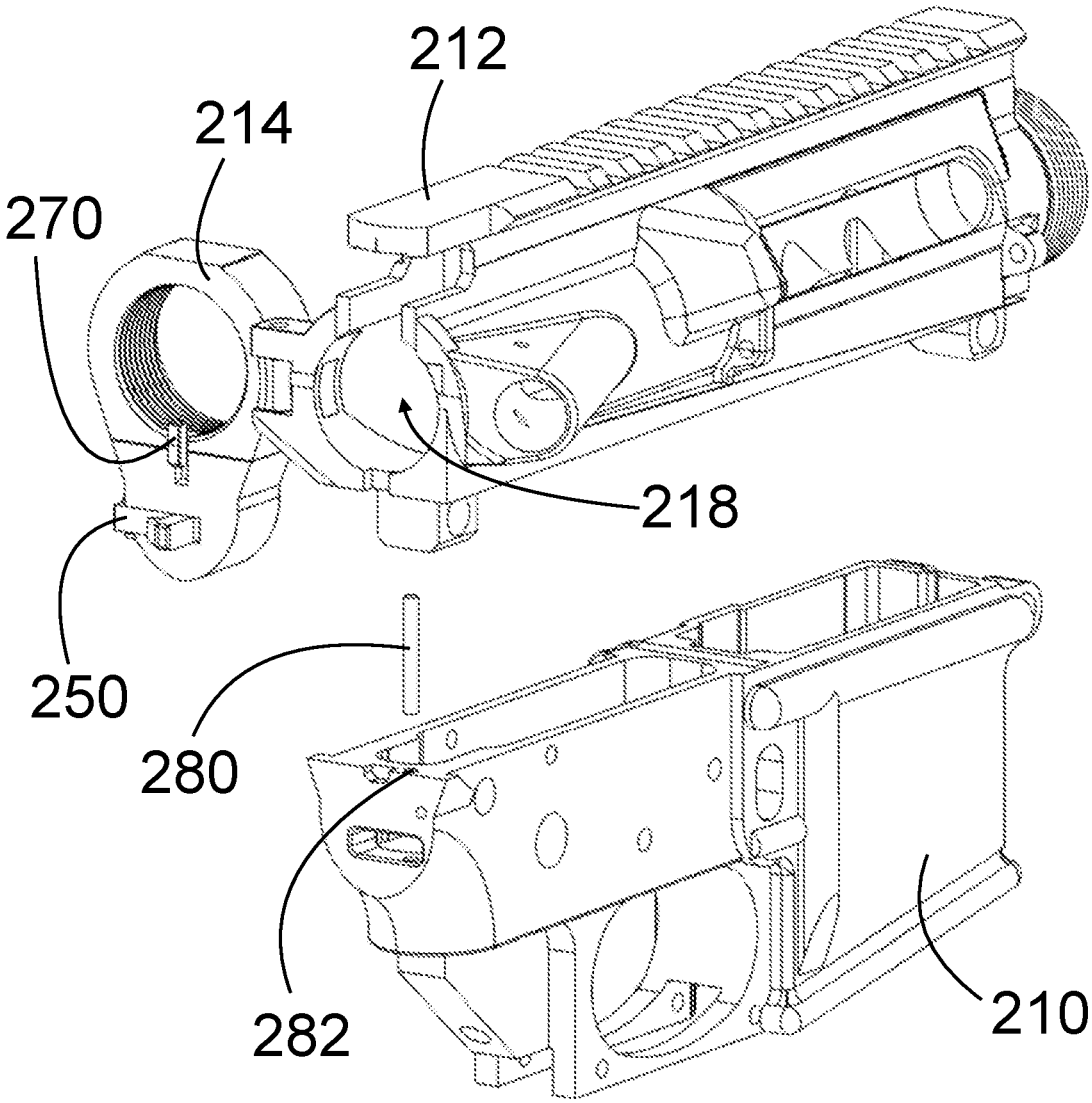
FIG. 36 is an exploded perspective view of the Hinged Firearm Receiver with the hinge joint in the open position.

FIG. 35 and FIG. 36. display an exploded perspective embodiment of a Hinged Firearm Receiver 300 with the hinged joint in the open position. This embodiment is similar to the Hinged Firearm Receiver 200, with the difference being that that lower receiver contains the locking feature 280. As displayed in FIG. 36, a locking feature 280 is placed into the lower receiver 210 through a locking feature hole 282.

Although the illustrated embodiments shown are descriptive of an ar15 pattern receiver, this invention and its claims are intended to extend to pistol caliber ar15 pattern receivers, and ar10 pattern receivers, or the like. Ar15 pattern lower receivers can be identified by their ability to accept ar15 pattern trigger groups, magazines, and pivot pins locations with the ability to accept or mate too ar15 pattern, ar10 pattern, or the like upper receiver groups. Ar15 and Ar10 pattern upper receivers can be identified by the ability to accept ar15 or ar10 pattern barrels and bolt carrier groups. Further, embodiments are not limited to mil-spec ar15 pattern receivers and extend to improvements to any and all ar15 pattern receivers. Incomplete ar15 pattern receivers, such as 80% receivers, are also intended to be covered by the spirit and scope of this invention. Those skilled in the art will appreciate the many receiver variations that qualify as ar15 pattern receivers. AR-pattern, ar pattern, and ar15 pattern are used interchangeably.

Further, drawings depicting buffer tubes, buffers, buffer springs, bolt carrier groups, trigger groups, and takedown pins are not included in the drawings. These terms are referenced in the description as parts that interact with the invention. Those skilled in the art understand the commonality of these parts and appreciate how they interact with the invention compared to common and standard ar15 pattern receivers.

Other embodiments of the latch assembly may exists. For example, a hinge lock, hinge stop, or hinge latch mechanism may be used to achieve the same result to hold the hinge joint in the closed position. The method of the latch assembly described in the embodiments is not intended to limit the scope of the claims or the spirit of the invention.

What is claimed is:

1. A hinged firearm receiver set comprising: a lower receiver body; a rear receiver body configured to receive a buttstock; an upper receiver body; a dead hinge section connected to the upper receiver body; an active hinge section integral to the rear receiver body; a hinge joint configured to connect the upper receiver body and the rear receiver body allowing movement between an open and closed position; and wherein the dead hinge section and the upper receiver body are a unitary body.

2. The hinged firearm receiver of claim 1, wherein said firearm receiver contains a latch assembly that holds the rear receiver in the closed position.

3. The hinged firearm receiver of claim 1, wherein said firearm receiver contains a blocking feature to interrupt the bolt carrier group passage.

4. The hinged firearm receiver of claim 1, wherein said firearm receiver contains a latch assembly that automatically holds the rear receiver in the closed position.

5. The hinged firearm receiver of claim 1, wherein said firearm receiver contains a latch assembly that comprises a spring.

6. The hinged firearm receiver of claim 1, wherein said firearm receiver contains a latch assembly that comprises a button.

7. The hinged firearm receiver of claim 1, wherein said rear receiver contains a buffer retaining feature.

8. The hinged firearm receiver of claim 1, wherein said rear receiver contains a buffer tube receiving thread portion.

9. A hinged firearm receiver set comprising: a lower receiver body; a rear receiver body configured to receive a buttstock; an upper receiver body; a dead hinge section connected to the upper receiver body; an active hinge section integral to the rear receiver body; a hinge joint configured to connect the upper receiver body and the rear receiver body allowing movement between an open and a closed position; a latch assembly that holds the rear receiver in the closed position; a buffer retainer feature within the rear receiver body; a buffer tube receiving thread portion integral to the rear receiver body; and wherein the dead hinge section and the upper receiver body are a unitary body.

10. The hinged firearm receiver of claim 1 including a bolt operable to reciprocate between a recoil position and a battery position, and the bolt having a rear end forward of a rear end of the upper receiver body when the bolt is in the battery position.

11. The hinged firearm receiver of claim 9 including a bolt operable to reciprocate between a recoil position and a battery position, and the bolt having a rear end forward of a rear end of the upper receiver body when the bolt is in the battery position.

* * * * *